US009133596B2

(12) United States Patent
Carter, Jr.

(10) Patent No.: US 9,133,596 B2
(45) Date of Patent: Sep. 15, 2015

(54) METHOD FOR CONSTRUCTION OF SUBTERRANEAN BARRIERS CROSS REFERENCE TO RELATED PATENT APPLICATIONS

(76) Inventor: Ernest E. Carter, Jr., Sugar Land, TX (US)

( * ) Notice: Subject to any disclaimer, the term of this patent is extended or adjusted under 35 U.S.C. 154(b) by 813 days.

(21) Appl. No.: 12/600,111

(22) PCT Filed: Jun. 2, 2008

(86) PCT No.: PCT/US2008/007023

§ 371 (c)(1),
(2), (4) Date: Jul. 28, 2010

(87) PCT Pub. No.: WO2008/150531

PCT Pub. Date: Dec. 11, 2008

(65) Prior Publication Data

US 2010/0232881 A1 Sep. 16, 2010

Related U.S. Application Data

(60) Provisional application No. 60/932,557, filed on May 31, 2007.

(51) Int. Cl.

| | |
|---|---|
| ***B65G 5/00*** | (2006.01) |
| ***E02D 19/16*** | (2006.01) |
| ***E02D 31/02*** | (2006.01) |

(52) U.S. Cl.

CPC ..... *E02D 19/16* (2013.01); *E02D 31/02* (2013.01)

(58) Field of Classification Search

USPC ..... 405/232–234, 240, 248, 263–270, 274, 405/275, 129.35, 129.45, 129.55, 129.6, 405/129.65; 166/288; 588/250

See application file for complete search history.

(56) References Cited

U.S. PATENT DOCUMENTS

| | | | | |
|---|---|---|---|---|
| 4,697,953 | A * | 10/1987 | Nussbaumer et al. | 405/129.6 |
| 4,909,674 | A * | 3/1990 | Konno et al. | 405/267 |
| 5,542,782 | A * | 8/1996 | Carter et al. | 405/129.75 |
| 5,765,965 | A * | 6/1998 | Carter et al. | 405/129.65 |
| 5,879,110 | A * | 3/1999 | Carter, Jr. | 405/267 |
| 5,890,840 | A * | 4/1999 | Carter, Jr. | 405/129.55 |
| 6,280,521 | B1 * | 8/2001 | Carter, Jr. | 106/724 |
| 6,305,880 | B1 * | 10/2001 | Carter et al. | 405/184.3 |
| 6,569,235 | B2 * | 5/2003 | Carter, Jr. | 106/724 |
| 6,860,936 | B2 * | 3/2005 | Carter, Jr. | 106/718 |
| 2001/0048854 | A1 * | 12/2001 | Carter, Jr. | 405/266 |
| 2002/0009331 | A1 * | 1/2002 | Carter, Jr. | 405/129.55 |
| 2003/0205174 | A1 * | 11/2003 | Carter, Jr. | 106/724 |

FOREIGN PATENT DOCUMENTS

JP 07305343 A 11/1995

OTHER PUBLICATIONS

Official Action to Japanese Patent Application Serial No. JP2010510375 dated May 22, 2012.

* cited by examiner

*Primary Examiner* — Tara M. Pinnock
(74) *Attorney, Agent, or Firm* — Jones Walker LLP

(57) ABSTRACT

A method for forming a barrier in a subterranean formation is described comprising connecting two pipes to each other by a tensile member, cutting a continuous path through the subterranean formation with the pipes and tensile member, and providing grout into the path. An apparatus for forming such a barrier is described comprising a tensile member, at least two pipes wherein the pipes are connected to the tensile member wherein the pipes are configured to deliver grout to the subterranean formation, and at least one drilling apparatus wherein the drilling apparatus, pipes, and cable are configured to cut a path through the subterranean formation.

19 Claims, 18 Drawing Sheets

Fig. 7a Section A-A

Fig. 7b Section B-B

Fig. 14d
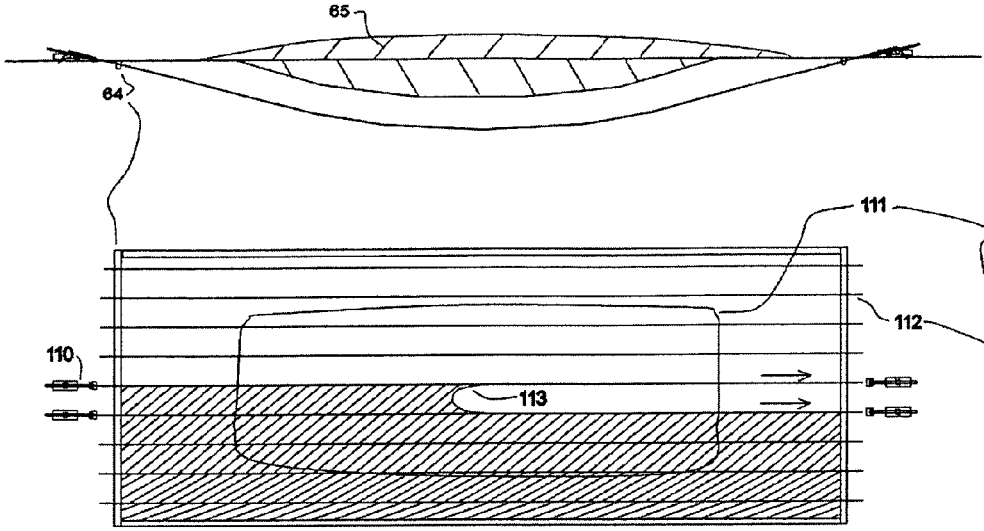
Fig. 14a
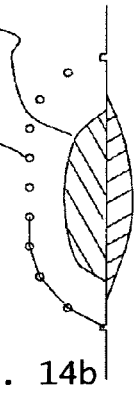
Fig. 14b
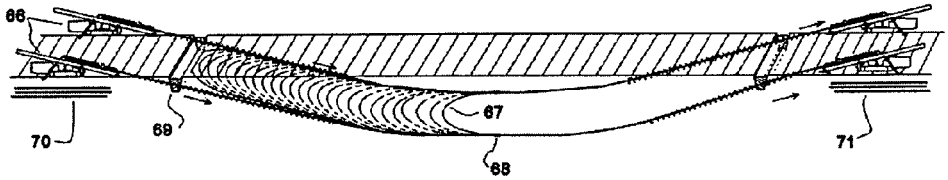
Fig. 14c

METHOD FOR CONSTRUCTION OF SUBTERRANEAN BARRIERS CROSS REFERENCE TO RELATED PATENT APPLICATIONS

BACKGROUND

1. Field of the Invention

The present invention relates to methods for forming subterranean barriers for purposes of containment, typically containment of solid and liquid waste. The techniques described herein are applicable to both vertical and horizontal barriers.

2. Description of the Related Art

Subterranean barriers are generally used to restrict the movement of underground water for pollution prevention, civil construction, or groundwater management. Vertical barriers are commonly made by slurry trenching, sheet piles, jet grouting, pressure grouting, and many other methods. Methods vary in depth capability, hydraulic quality, and the types of earth that can be subjected to the containment process.

There are many methods of constructing vertical barriers but few proven means of constructing a horizontal barrier without first removing the soil over the area where the barrier is needed. As removing the overburden soil may be costly or hazardous, construction of a horizontal barrier in situ may be desirable. Many landfills containing trash, municipal waste, and mining waste materials were developed with no liner at all and represent a potential threat to groundwater that could be remedied by construction of a bottom barrier. There are many earthen dams and levees, which are at risk of failure due to small leaks, that would benefit from a safe and inexpensive method of forming a flexible but water-tight vertical barrier down their centerline.

As described in U.S. Pat. No. 5,890,840, which is hereby incorporated by reference herein, a method of creating horizontal basin shaped barriers under a contaminated site has been contemplated. Horizontal directionally-drilled holes were drilled under the site and a pipe with several non-crossed cables running the length of the pipe was installed into each hole. At the edge of the site, where the pipes and cables exit the holes, one cable from each adjacent hole was selected and joined to the cable from the adjacent hole. The free end of these two cables at the other side of the site was attached to dozers, winches, or other pulling means to pull on the cables causing them to slice through the soil between the two holes. Dense fluid grout was continually supplied to the holes to fill the cut, e.g., swath or path, formed by the passing of the cable. The pipe served the purpose of orienting the cables and preventing rotation of the cables as they were initially pulled into the hole which would cause them to become crossed. Crossed cables would interfere with the cutting process.

Problems with this method included trying to keep the cables from crossing when drawing the pipe and cables into the hole and the tendency of the cables stretched along a curving borehole to cut into the walls of the holes such that the barrier did not follow the original path of the holes. The vertical curvature of the holes and the cable tension required to cut the path between adjacent holes would result in the cable cutting upward from the hole for a short distance before turning horizontally toward the adjacent hole. This vertical portion of the cut would not be expanded by the buoyancy of the dense fluid grout and so would be a significant defect in the otherwise uniform bottom barrier.

FIGS. 1*a* and 1*b* show a prior art process for forming a thin vertical subterranean hydraulic barrier. FIG. 1*a* illustrates the construction of thin diaphragm walls, or "panels" by jet grouting. In this method, cement grout is sprayed from jet nozzles 1 as a pipe 7 is moved upward through the ground which impinges the soil to form a mixture of cement grout and soil. In the centerline cross sectional view of the wall in FIG. 1*b*, the jet blast 2 from the nozzles 1 is directed in an "X" shaped pattern with an included angle 3 selected to help assure continuity of the wall. The pipe 7 is typically driven down into the ground to a desired depth using larger jet nozzles 4 on the tip of the pipe 7 that are pointed downward. After the pipe 7 reaches depth, a ball 5 is dropped to plug the larger jets 4 so that grout flows out of the smaller jets 1 that will create the jetted wall or barrier. 6. Intersection of the grouted soil cement panels depends on the pipes being properly aligned and the power and rate of movement of the jets 1 being suitable to completely cut through the soil between adjacent pipes.

In commercial applications, thin vertical or horizontal subterranean barriers may be constructed by using drill pipe 7 with 2 or 4 opposed orifices 1, "jets" or "nozzles," that eject streams of fluid cement grout in opposing directions while raising the drill pipe 7 without rotation. When using two jets 1 on each side of the pipe 7, the jets 1 are each directed a few degrees, 10 to 45 degrees to either side of the direction of the adjacent drill pipe positions, to improve the chances of the spray from at least one intersecting the spray from the next pipe. Each stream of grout cuts vertical planar paths through the soil leaving a mixture of cementitious grout and soil that hardens into planar vertical panels. Multiple adjacent panels may be constructed such that they overlap to form a hydraulic barrier wall in situ in the ground.

These barriers are often called "X panel walls" 2 when made with 4 jets as in FIGS. 1*a* and 1*b* or "thin diaphragm walls" when made with only 2 jets. Such walls require much less time and material to form compared to jet grouted walls made of joined circular columns. However these thin walls are more likely to have leaks due to rocks, hard soil, or obstructions within the native soil that disrupt the penetration of the jet. Adjacent panels may also fail to intersect because of incorrect drill pipe orientation or variations in spacing between holes formed by the drill pipe. Sometimes the jets do not penetrate as far through the soil as expected or they are not oriented properly and miss the adjacent panel. These problems generally increase with increasing depth.

Even when formed as planned, these thin walls made of soil and cement sometimes do not work very well for several reasons. The permeability of jet grouted soil-grout mixture is relatively high. So, a thin wall does not impede water movement as much as a thicker wall made of interconnected columns. Also, such thin walls may crack due to soil movements and drying shrinkage. Traditional cement or cement and bentonite slurries often have lumps which partially plug a jet without the knowledge of the operator causing a defect in the wall.

Other installation problems exist. The jetting is generally only performed on the way out of the ground. Jetting with cement slurry typically forms panels up to 2 feet away from the drill pipe but adding a concentric jet of air around the jet can increase penetration up to 7 feet from the drill pipe allowing a 14 foot wide panel to be formed while returning large volumes of soil, water, and grout to the surface. Also, jet-grouted columns may be formed with molten wax using jet nozzles on a rotating drill pipe. One problem with this process is that the wax is far more costly than cement grout and thus the relatively large volume required to form jet grouted columns makes the use of molten wax too expensive for widespread use outside the nuclear industry.

Therefore, an economical, effective method and apparatus to form a barrier in a subterranean formation is needed.

SUMMARY

The present invention relates to methods for forming subterranean barriers for purposes of containment, typically containment of solid and liquid waste. The techniques described herein are applicable to both vertical and horizontal barriers.

In accordance with one aspect of the present invention, methods for forming a barrier in a subterranean formation are described comprising connecting two pipes to each other by a tensile member; cutting a continuous path through the subterranean formation with the pipes and tensile member; and providing grout into the path.

In accordance with another aspect of the present invention, various apparatus for forming a barrier in a subterranean formation are described comprising a flexible tensile member; at least two pipes wherein the pipes are connected to the flexible tensile member and wherein the pipes are configured to deliver grout to the subterranean formation; and at least one drilling apparatus wherein the drilling apparatus, pipes, and cable are configured to cut a path through the subterranean formation.

The features and advantages of the present invention will be readily apparent to those skilled in the art. While numerous changes may be made by those skilled in the art, such changes are within the spirit of the invention.

BRIEF DESCRIPTION OF THE DRAWINGS

FIGS. 7*a*, 7*b*, and 7*c* are schematic illustrations of a cable end attached to an external flange on a pipe in accordance with one embodiment of the present invention.

FIGS. 13*a*, 13*b*, and 13*c* are schematic illustrations of a tool connected between sections of pipe that allow a tether cable to be attached and extend between two adjacent holes in accordance with one embodiment of the present invention.

FIGS. 14*a*, 14*b*, 14*c*, and 14*d* provide schematic views of a multi-section horizontal basin barrier being constructed under a landfill or other contaminated site in accordance with one embodiment of the present invention.

DESCRIPTION OF PREFERRED EMBODIMENTS

The present invention relates to methods for forming subterranean barriers for purposes of containment, typically containment of solid and liquid waste. The techniques described herein are applicable to both vertical and horizontal barriers.

Generally, in accordance with the present invention, an economical, effective barrier in a subterranean formation is formed. Performing the work with only a pipe in each directionally drilled hole and eliminating the prior art's cables extending the length of the directionally drilled hole are features of the various embodiments of the present invention.

The pipe itself is pulled or pushed through the hole and a tensile member, such as a cable, is attached as a cutting element between two adjacent pipes. The larger surface area of the pipes relative to the tensile member making the cut path prevents the pipe from cutting into the wall of the curved holes so the cut path extends generally horizontally straight between holes along the shortest path between the holes.

Long pipes placed into the ground are relatively flexible and can be displaced both spatially and rotationally from their intended location. In accordance with various embodiments of the present invention, controlling this orientation is achieved by tethering the pipes together with a tensile member. The tensile member trails behind the cut path being formed by the jets positioned on the pipes and keeps the jets in proper alignment and prevents the pipes from moving too far apart. The tensile member also helps assure the continuity of the cut path since it must physically pass through the pathway of the cut. The cable also passes through the cut path a second time on the way out of the hole. Then, the cut path formed by its passage is immediately filled with grout.

In general, the attachment of the tensile member to the two adjacent pipes can be viewed as a cutting method and a technique for maintaining the rotational orientation of the jets on adjacent pipes toward one another. The tensile member also keeps the roughly parallel pipes from moving too far apart for the jet blasts to intersect. "Parallel" and "roughly parallel" are used interchangeably in this application to refer to holes and pipes within the holes that travel in generally the same direction but for which the spacing between two adjacent holes and pipes within the holes may vary significantly along their length. For example holes that are nominally 20 feet apart may vary between 5 feet and 40 feet apart and still be considered "roughly parallel" or "parallel" in this application because they travel in the same general direction. Horizontal directionally drilled holes are not generally straight but follow an erratic course as position measurements and directional adjustments are made continually. Also in forming basins, the adjacent holes may require a greater spacing in some areas than others.

Figure 1A:
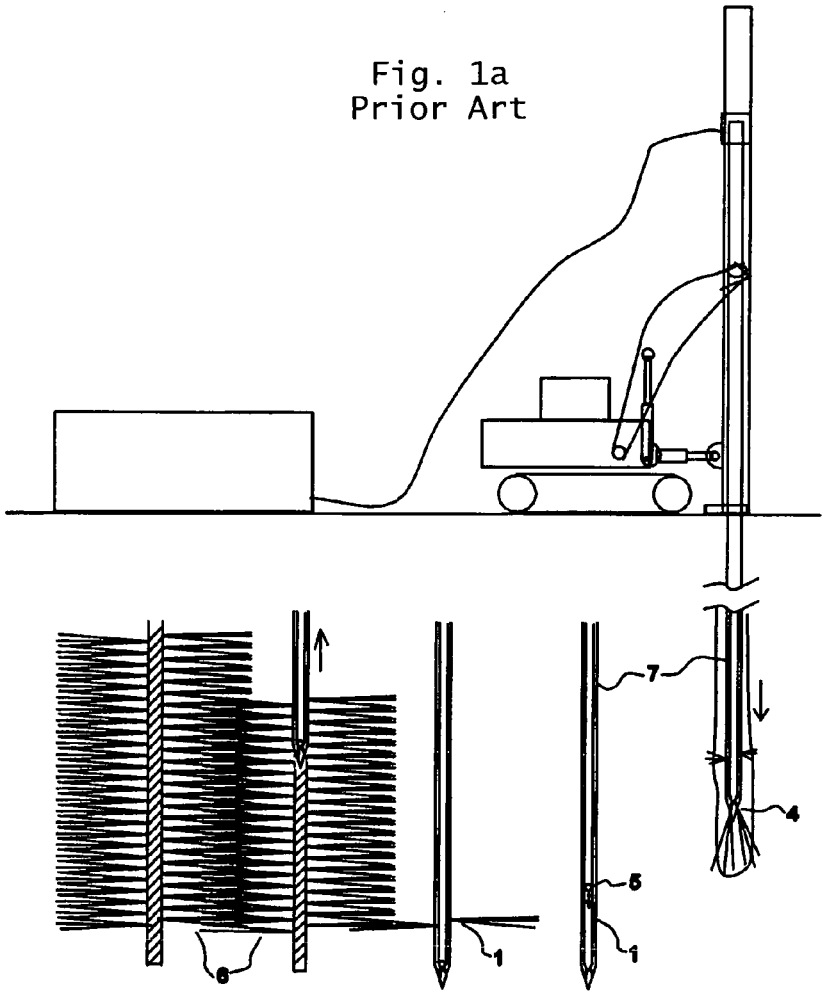
Fig. 1a Prior Art
FIGS. 1*a* and 1*b* are prior art illustrations of a conventional jet grouting apparatus used to form an X panel subterranean barrier wall.
Figure 1B:
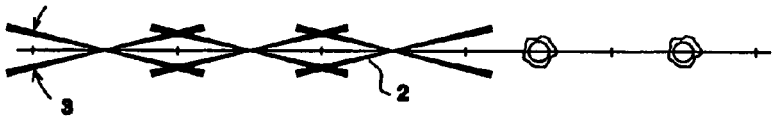
Fig. 1b Prior Art
Figure 1C:
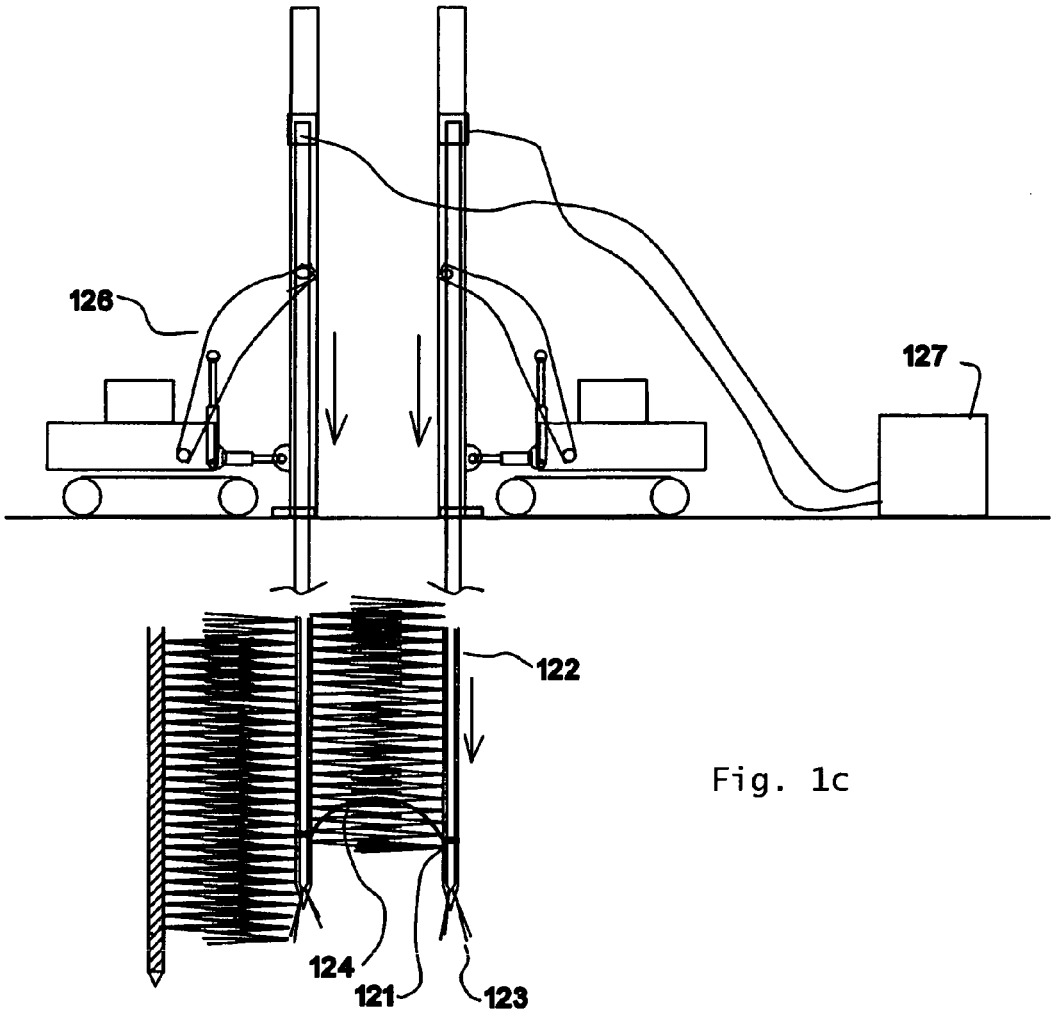
FIGS. 1*c* and 1*d* are illustrations of a jet grouting apparatus to form a panel subterranean barrier wall in accordance with one embodiment of the present invention.
Figure 1D:
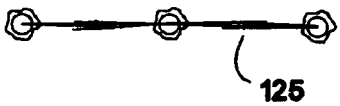

Rig Based Tethered Dual Jetting Pipes (FIGS. 1*c* and 1*d*)

The depth range of the panels formed using the prior art method illustrated by FIGS. 1*a* and 1*b* is limited because as depth increases it is harder to be certain that the adjacent panels intersect. Verifying that one jet grouted panel intersects an adjacent panel may be readily performed in accordance with various embodiments of the present invention, such as illustrated in FIGS. 1*c* and 1*d*, by use of a second jetting pipe attached to the first by a mechanical tether comprising a tensile member, such as a wire rope cable. At least two jetting pipes are used at the same time. The two pipes 122 are linked with a tensile member 124, such as a spring, rigid bar, chain, or cable. Desirably, the tensile member is somewhat flexible. A preferred tensile member 124 is a cable, which is preferably made of steel wire rope. For convenience, the tensile member 124 may be referred to herein as a "tether cable;" however, the use of this term is not intended to limit the invention to the use of a tensile member of any particular construction.

Desirably, the tensile member 124 may be attached to the jetting pipes 122 at a position directly above the facing orifices 121 (e.g., grouting jets). This tensile member 124 acts as a proving gauge and helps verify that a continuous cut has been established between the jet blasts from adjacent jetting pipes 122. The tensile member 124 also helps assure that the jet blasts from the facing orifices 121 in the two separate jetting pipes 122 are directed toward one another so that they may intersect.

Multiple penetrations of the jetting pipes 122 into the earth along a path form a series of interconnected subterranean panels using a grout that is flexible but hydraulically impermeable. The panels may be formed in a vertical orientation from a vertical hole or may be at least partially horizontal using horizontal directional drilling techniques for the pipe.

As described, proper orientation and inter-hole spacing of the pipes may be enhanced by using two pipes 122 at the same time preferably driven by a machine that substantially fixes the rotational orientation and alignment of the grouting jets 121 between the two pipes 122 so that they intersect. This becomes increasingly difficult as the pipes 122 become longer and therefore relatively flexible.

As disclosed, the orientation of the grouting jets 121 for single thin diaphragm walls is controlled by attaching a tensile member 124 between two adjacent pipes 122 used together. The tensile member 124 may also provide a degree of mechanical cutting action and help assure continuity of the pathway cut between the opposing grouting jets 121 directed to the soil between the two pipes 122.

An advantage of this embodiment is reducing the volume of the costly grout material required by making a single thin diaphragm wall of sufficient quality so that a double "X" panel wall is not necessarily needed. Also, the jetting time required to assure a continuous wall is reduced because the tensile member 124 will provide a positive indication that the speed of pipe movement is sufficient to cut a full pathway.

The pipe speed may be increased or decreased as needed to minimize jetting time. This double pipe and connected tensile member approach is highly advantageous for subterranean walls made of wax but can also improve the quality of panels formed with traditional grout materials, such as those made from bentonite and cement, molten tar, or sodium silicate.

A drill pipe 122 or other conduit comprising at least one or more jet nozzles is driven, drilled, or otherwise forced into the ground to the desired location by a suitable rig 126. The hole in the ground may alternately be pre-drilled or the pipe may be driven in with the aid of a downward facing jet nozzle(s) 123 or it may be forced into the ground by a hydraulic hammer.

In preferred embodiments, the jetting can be performed at least as the pipe is driven into the ground and optionally on the way out as well. When molten wax is used as the grout, it can be delivered from a tanker truck or other container 127, circulated through a heater, a high-pressure pump, and hose that forces it into the drill pipe at high pressure, resulting in a powerful spray exiting the grouting jets 121.

Figures 2A, 2B:
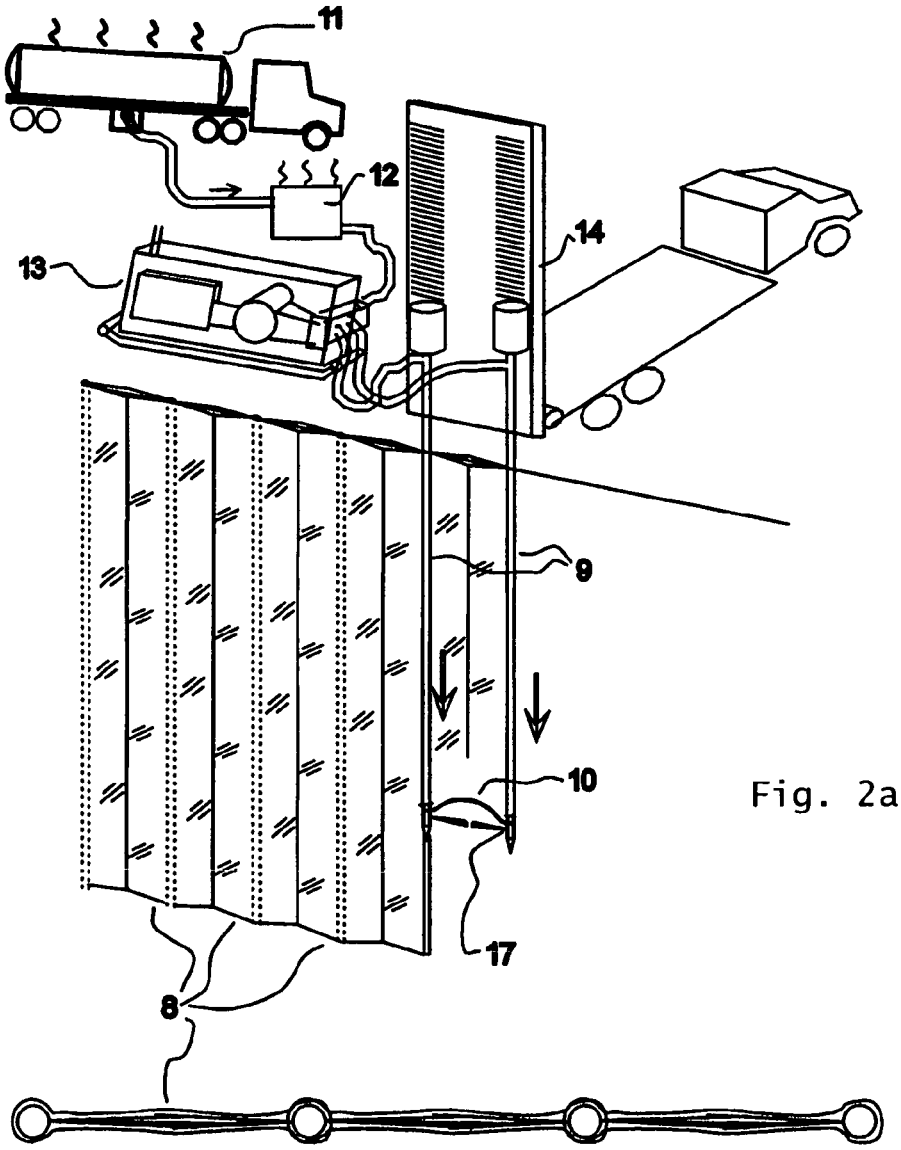
FIGS. 2*a* and 2*b* are illustrations of a simple truck mounted dual pipe driving apparatus driving two pipes connected with a cable vertically into the ground in accordance with one embodiment of the present invention.

Truck Mounted Pipe Drilling Apparatus Based Tethered Dual Jetting Pipes (FIGS. 2*a* and 2*b*)

In FIGS. 2*a* and 2*b*, multiple sections of jet grouted panels are formed by driving two jetting pipes 9 down through the earth at the same time to form a cut path that is filled with grout/soil mixture. Grout is injected on the way into the ground and optionally additionally on the way out of the ground. The multiple panels are joined due to the overlap 8 of the jet blast cutting between the pipes, as also shown in the centerline cross sectional view FIG. 2*b*. Each jetting pipe 9 has at least one jet nozzle (e.g., grouting jet) 17 to help cut the panel but also is connected by a tensile member such as cable 10 that extends between the two pipes 9 and assures that the panels will be connected even if the jets do not cut far enough. The cable also maintains alignment of the jets so that an X pattern is not needed to assure wall continuity.

As previously described, a preferred grout component is a molten wax which can be delivered in a tanker truck 11 and further heated by a heater 12 before entering a high pressure pump 13. A truck mounted drilling apparatus with a hydraulic hammer 14 can be used to push the pipes 9 down into the ground with sufficient force that the cable 10 can cut through the soil even if the jets do not. The drilling apparatus may handle both pipes 9, as shown, or may be comprised of two separate units. Both pipes 9 may be used to form new holes, or one pipe 9 can be inserted into a previously-formed hole while the other pipe 9 makes a new hole. Desirably, after each panel 8 is formed, the truck mounted apparatus is relocated so that one pipe 9 re-enters one of the previous holes while the second pipe 9 is making a new hole. In this way, continuity of the panels is assured from one pass to the next.

The pipe handling equipment preferably operates at least two parallel jetting pipes at once, separated by a distance that can be adjusted for the anticipated penetration distance of the jets into the soil. Two separate drilling units may also be used to perform the work, as in FIG. 11 described below, or a single combined unit, as shown in FIG. 2, may be used. The pipe handling equipment forces both pipes into the ground at the same time. The opposed grouting jets 17 may be directed slightly (2 to 15 degrees) downward to reduce splatter and personnel hazards when the jets are energized while still above ground.

The tether cable 10 is desirably connected to the jetting pipes 9 above the grouting jets 17 facing the other jetting pipe.

Sufficient slack in the tether cable 10 is desirably permitted such that as the tether cable 10 encounters resistance of soil it may form a catenary arc between the two jetting pipes 9. When the jets fail to create a complete pathway between the two jetting pipes 9, the tether cable 10 will halt the downward progress of the jetting pipes 9 or mechanically slice through the obstruction. If resistance is detected, the pipes 9 may also be reciprocated up and down in this area until the obstruction has been eliminated. Downward force on the jetting pipes 9 will cause the tether cable 10 to slice through the intervening soil and form a pathway. As the jetting pipes 9 are pulled back up through this area on the backward stroke, the grouting jets 17 will be able to access this area and widen the cut and further treat the adjacent soil with grout.

Forming a Structure in a Subterranean Formation (FIGS. 9, 10, 11, 14, 15, and 16)

Barriers formed by various embodiments of the present invention need not be entirely vertical, but may be horizontal, have a horizontal component, or even be shaped like a basin. For example, barriers may be in the form of a "V" shaped trough. A trough with vertical sides and flat bottom may also be formed by connecting a horizontal bottom panel to vertical side walls.

Simpler vertical barrier techniques are first described, with the concepts then applied to horizontal barriers. As previously described, a pipe may be pushed downward into a pre-drilled hole or may form a hole as it is mechanically driven through the earth. Horizontal directionally drilled holes may be employed to allow horizontal barriers to be constructed with variable geometry. The spacing between the roughly parallel holes may vary significantly but the attached flexible cable trails in a loop that desirably can be adjusted to variations in spacing.

Barriers are comprised of multiple panels that are joined together. The barriers are created from multiple roughly parallel holes in the ground. Pipes in two adjacent holes are attached to a tethered cable that extends between the pipes. As the pipes move longitudinally through the holes, the tethered cable between the pipes slices through the earth between the holes like a knife. As the pathway is cut between each adjacent pair of holes it is filled with a barrier-forming grout to form each panel of the barrier. The next panel is formed using one hole from the previous section and one new hole. The panels may be thin and flat formed between straight holes or may be complex ribbon shapes between curving holes that are combined to form more complex geometries such as basins. In various embodiments, two panels could be formed with a gap between them and then a third panel could be formed to join them using one pipe in each of the nearest holes of the previous panels.

Figure 9:
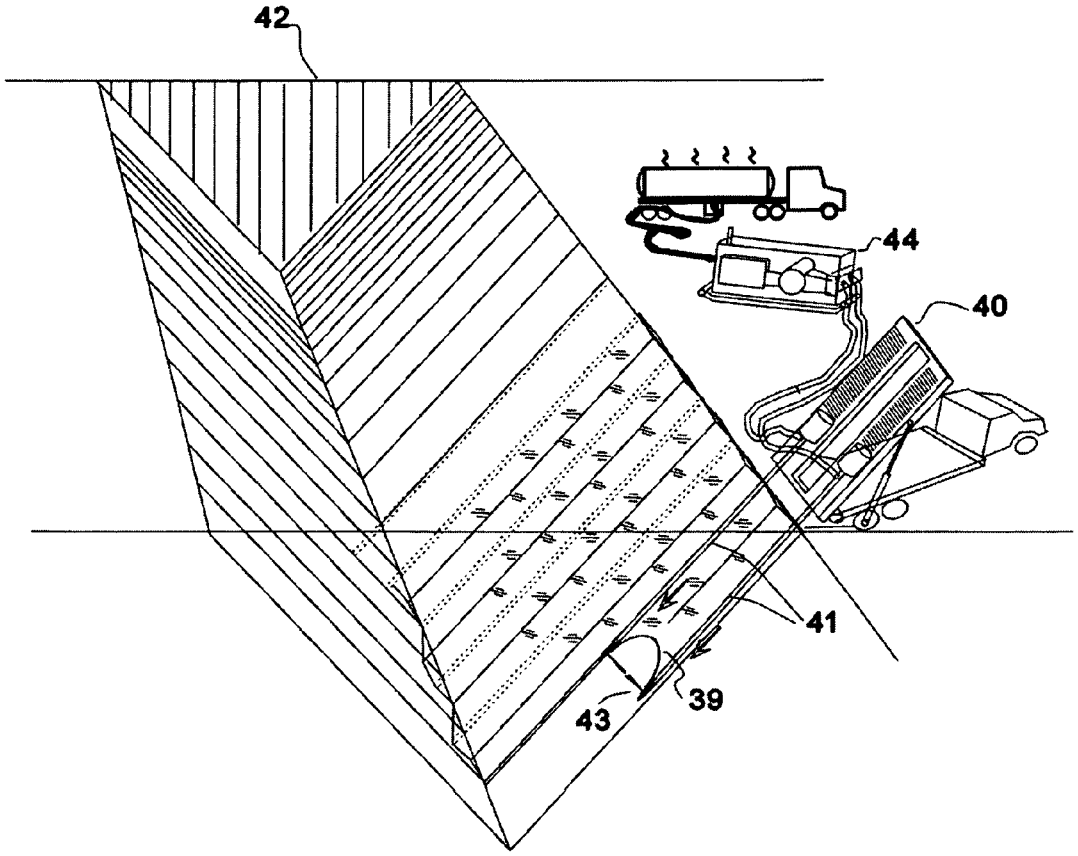
FIG. 9 is a schematic illustration of a pipe driving apparatus with dual tethered jetting pipes being used to form a "V" shaped trench of impermeable material in accordance with one embodiment of the present invention.

FIG. 9 shows a pipe driving apparatus with dual tethered jetting pipes being used to form a "V" shaped trench of impermeable material, by repeatedly plunging the apparatus into the ground and pulling it back up while spraying molten wax or other grout through the opposed nozzles 43. The pipe handling system is shown on the bed of a truck but it could also be mounted on crawler tracks or could be mounted sideways so that the unit could be more quickly positioned from one position to the next.

In FIG. 9, a truck mounted hammer drill apparatus 40 drives pipes 41 downward into the ground that are connected by a tethered cable 39. Barrier forming grout from a truck is pressurized by high pressure pump 44 and ejected from jets 43 aligned by the tethered cable 39 to form a continuous cut path between the pipes 41 to create multiple interconnected panels that form a subterranean barrier 42 in the ground.

Figure 10:
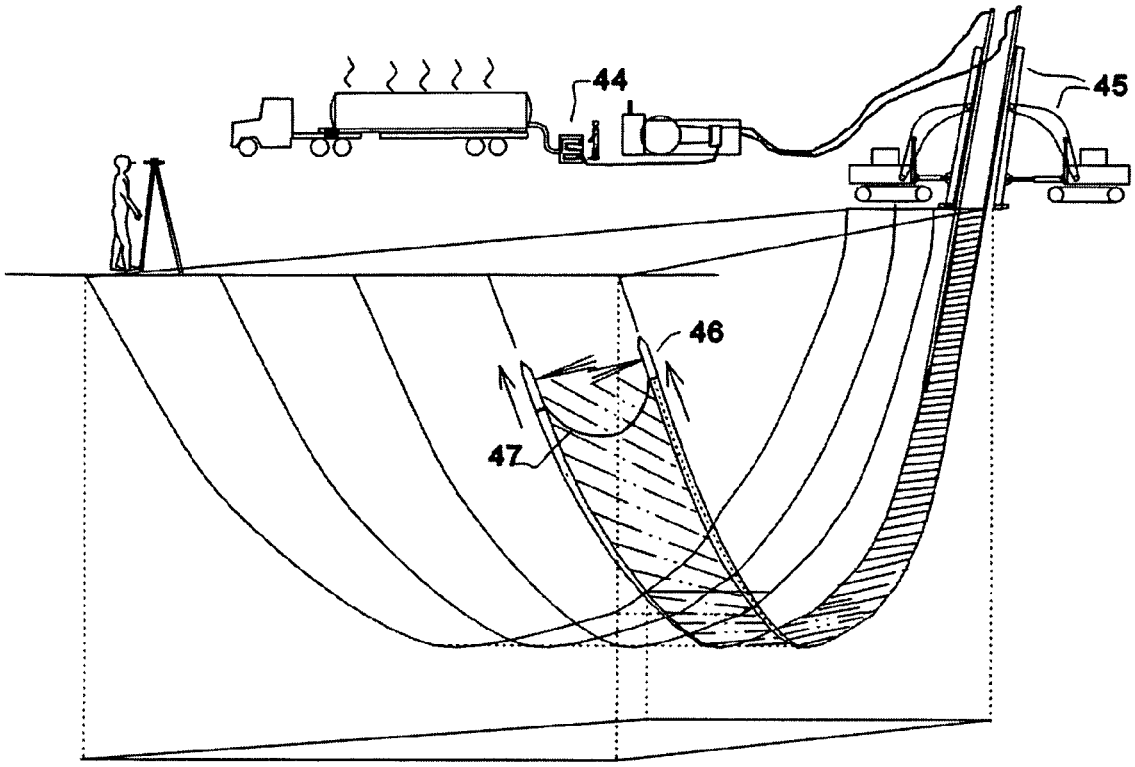
FIG. 10 is a schematic illustration of two drill machines pushing the pipes into horizontal directionally-drilled holes in accordance with one embodiment of the present invention.

FIG. 10 shows two drill machines operating in horizontal directionally drilled holes. In such embodiments, the holes are preferably pre-drilled because operating a bent sub-directional steering method is incompatible with keeping the tether in its fixed orientation for constructing thin diaphragm walls. The pipe handling means could also be comprised of two coil tubing units since only minimal thrust on the pipe is required for operating in pre-drilled holes. The use of pre-drilled holes may be overcome by relying on only the cable to perform the cutting without jets and having the cable attached to the pipes in such a way that the pipes may rotate independently of the cable, as described later in this specification regarding FIG. 12.

In FIG. 10, molten wax grout is heated by an in-line heater 44 and pumped at high pressure to a pair of pipe driving units 45 equipped with a hydraulic hammer that drives pipes into the ground along calculated paths or through pre-drilled holes that describe the path of the desired barrier. Pipes have a pointed tip equipped with jets 46 that cut through the soil and form a grout filled pathway in the earth between the pipes. A cable 47 maintains jet alignment and assures continuity of the cut path. The total included angle of the underground pathway is exaggerated for illustration.

In instances where an obstruction is encountered, the pipes can be backed up a few feet to focus the jets on the obstruction. For very long panels, the molten wax or other grout in the panel may solidify before the pipes can be pulled back. In such instances, when the pipes have exited the surface (as in FIG. 10), the tethered cable may be removed before pulling the pipes back. As soon as one panel is completed, pipes will be pulled back to the drilling machine and repositioned with one pipe in the just completed hole and one pipe in undisturbed soil. In this manner, continuity from one panel to the next is assured. A series of such interconnected panels may form a variety of underground barriers, including a basin shaped structure that could act as a containment barrier under a waste disposal site such as a landfill.

Figure 11:
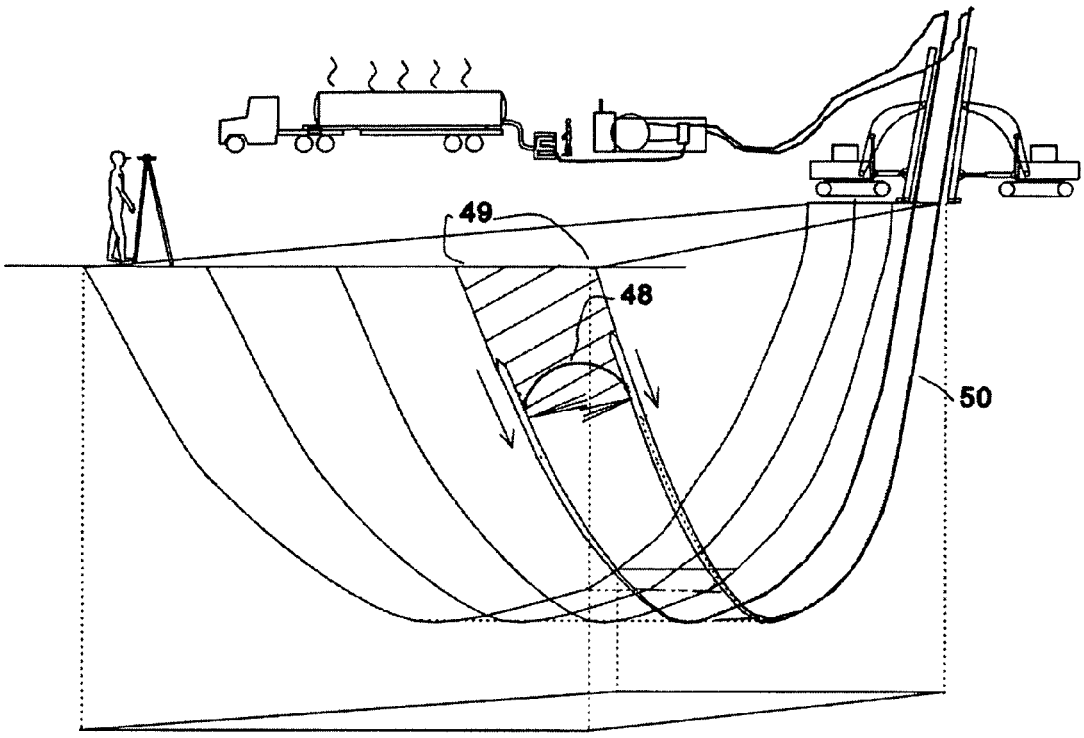
FIG. 11 is a schematic illustration of two drill machines pulling the pipes through pre-drilled holes that are accessible at both ends in accordance with one embodiment of the present invention.

FIG. 11 shows pre-drilled holes that are accessible at both ends. The barrier path is cut by pulling pipes 50 back through pre-drilled holes 49 with jets cutting the barrier and dragging a tethered cable 48 to assure continuity of the barrier. The jetting nozzle and tethered cable 48 may be attached to the adjacent drill pipes just prior to the pipes being pulled back through the holes, thus avoiding the need to push on long pipes that have the drag of an attached tethered cable 48. In this case, the tethered cable 48 would be attached trailing the jet nozzle in a solid section of the pipe such as the embodiment illustrated by FIG. 4.

In FIG. 11, an alternative method is shown wherein the directionally drilled holes are placed independently and the jetting is performed only on the pull-back stroke. In this method the tethered cable 48 is desirably located on the other side of the jets so that the jets can carve the pathway from the terminal end of the holes 49 back toward the drilling rig end. The tethered cable 48 is desirably attached only after the jetting pipes have already broken through to the surface at the terminal end. After the method of FIG. 10 has jetted the initial panel, the tether cable or the jets could be moved to implement the method of FIG. 11 on the pull-back stroke. This double-cutting could provide enhanced quality. In various alternative embodiments, the pull-back stroke could also be used to pull a sheet of synthetic liner material into the cut. Such a liner material could be attached to the tethered cable 48 at multiple points to provide an even pull and allow the liner to wrinkle slightly if the spacing between the pipes varies.

FIG. 14*d* shows an embodiment in which a horizontal barrier is formed using pre-drilled horizontal directionally-drilled holes. In this embodiment, the holes are cut with the cable alone and no jetting is used. The holes are filled with a grout, desirably a high density bentonite grout that is denser than the soil so that the grout flows into the cut and floats the overburden soil such that the horizontal cut does not close up. The holes enter the ground passing through a trench 64 that is filled with more of the grout forming a shallow arc under the landfill or other contaminated site that may be mounded up above grade 65. FIGS. 14*a* and 14*b* provide sectional views of the embodiments illustrated by FIGS. 14*d* and 14*c*. Pipes 112 connected by tensile member 113 are pulled by pipe-handling machine(s) 110 to form a barrier around a contaminated site 111.

FIG. 14*c* shows a non-scaled view wherein the pipe handling apparatus 66, the cutting cable 67, cable subs 68, and the grout filled trenches 69 may be clearly seen. Pipe sections may be removed and stacked 71 and placed for re-use 70 on the other end.

Figure 15:
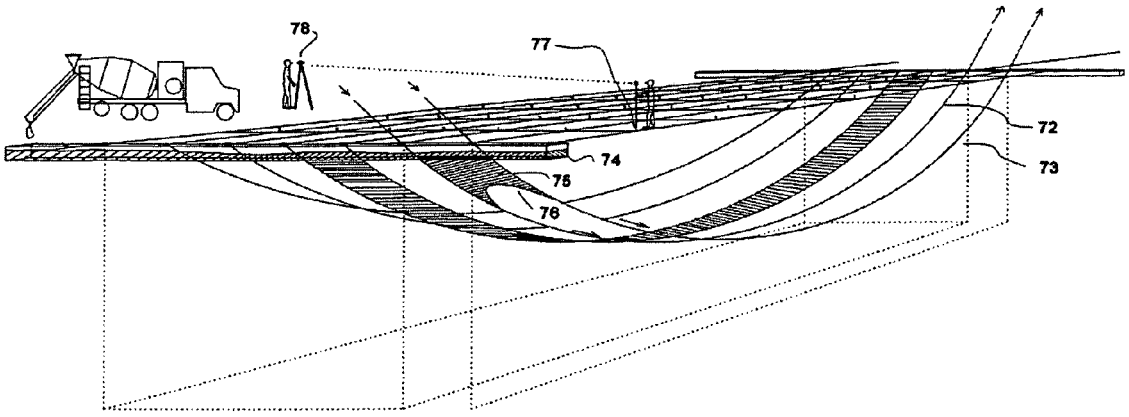
FIG. 15 is a schematic view of an arc shaped barrier under construction with a topographic survey monitoring barrier thickness in accordance with one embodiment of the present invention.

FIG. 15 shows another view of the same example as FIGS. 14*a*, 14*b*, 14*c*, and 14*d* without the pipe handling equipment visible. The directionally drilled holes have been pre-installed under the site and are kept open by hydrostatic force from high density grout in a trench 74 at either end. Pipes 72 and 73 are in the directionally drilled holes and can be pulled in either direction. The foreground panel section 75 or "ribbon" is being cut by the cable 76 as the pipes 72 and 73 are pulled back through the hole. The ground surface above the cut is covered with a grid of survey markers 77 and is being measured by a topographic survey 78 to monitor the elevation change due to the cut.

Figure 16:
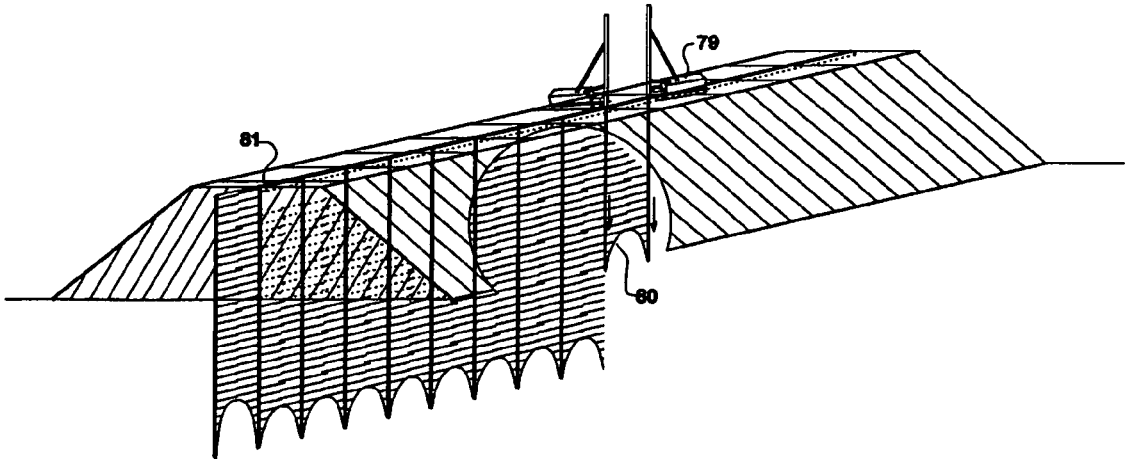
FIG. 16 is a schematic view of a section of an earthen dam or levee wall having an impermeable vertical barrier installed along its centerline using two separate drill rigs with their pipes connected by a cable in accordance with one embodiment of the present invention.

FIG. 16 shows a levee or earthen dam having an impermeable centerline barrier installed. Two standard drilling rigs 79 rather than a special dual pipe rig are shown. The two pipes are attached to a cable 80 that cuts a pathway as the pipes are forced downward through the soil. A molten wax or other grout may be injected from the pipes near where the cable is attached. Optionally, the cables may be used as the only means of cutting the soil as shown here. This eliminates the high pressure jetting equipment. A high density barrier forming grout such as barite filled molten wax or hematite filled cement/bentonite grout may be gravity fed into the cut by a shallow trench 81 along the top of the levee or dam.

Cable and Pipe Embodiments (FIGS. 3-8 and 13)

Figure 3:
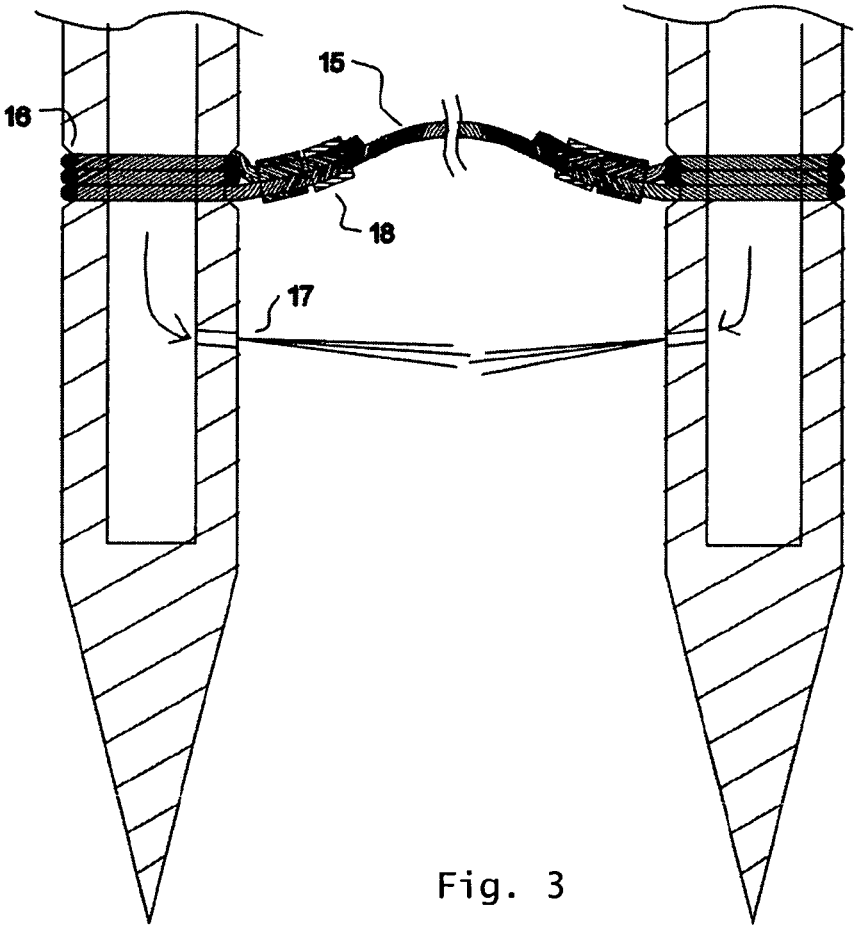
FIG. 3 is a schematic illustration of a pair of jetting pipes with a single opposed jet and with a wire rope cable in accordance with one embodiment of the present invention.

The tether cable may be attached to the pipes in any suitable manner. Non-limiting examples of various attachment methods are shown in FIGS. 3-8 and 13. In FIG. 3, a wire rope 15 is looped around a wide groove 16 on the outside diameter of the jetting pipe. The wire rope 15 is pulled tightly around the groove 16, and the two opposing strands of the wire rope are secured together with a suitable clamping device 18. That is, a cable is attached to the pipes by wrapping it around reduced diameter portion of the pipe and securing the ends to the cable inboard of the wrap, such as with cable swedge clips. These are just soft metal that is squeezed with a hydraulic press to form to the cable and secure two cables together. The pipes each have one drilled hole jet 17 pointed toward one another. The jet orifices 17 are holes drilled in the pipe that discharge grout. Friction helps maintain alignment between the cable and the jet. This embodiment can be more difficult to assemble in the field than other embodiments, but is suitable for thin wall pipe.

Figure 4:
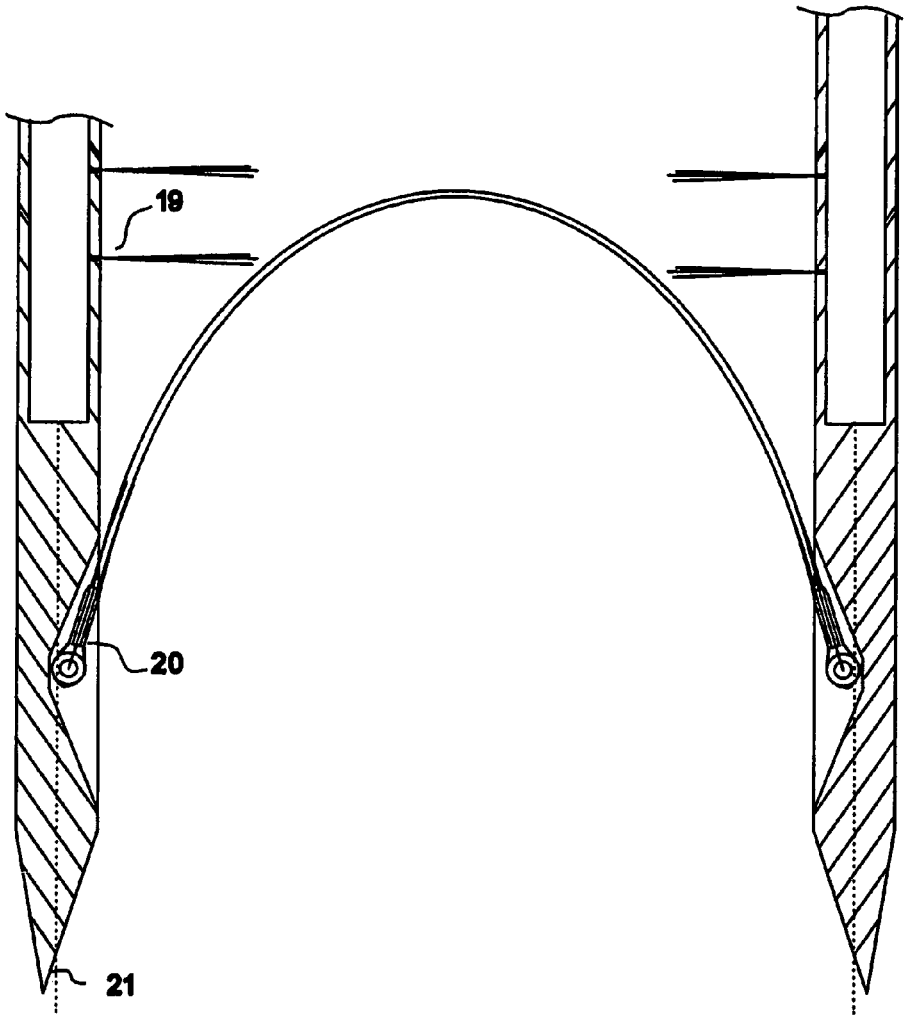
FIG. 4 is a schematic illustration of a pair of jetting pipes with two opposed jets and with a wire rope cable in accordance with one embodiment of the present invention.

FIG. 4 shows another method of attaching a cable 20 having closed wire rope socket ends connected by a pin into milled slots in the pipes so that they are free to rotate up or down without kinking the cable. Jets 19 above the cable attachment point are directed into the cut formed by the cable as pipes are driven downward into the earth. Each pipe would have at least one jet but could have more than one as shown here, and jets could be located above or below the point where the cable is attached. The jet thrust helps keep the pipes from getting closer as they are driven into the ground. The point of the pipes may also be designed with an offset shape 21 to generate additional lateral force to keep the pipes from being drawn together by friction on the cable.

Figure 5:
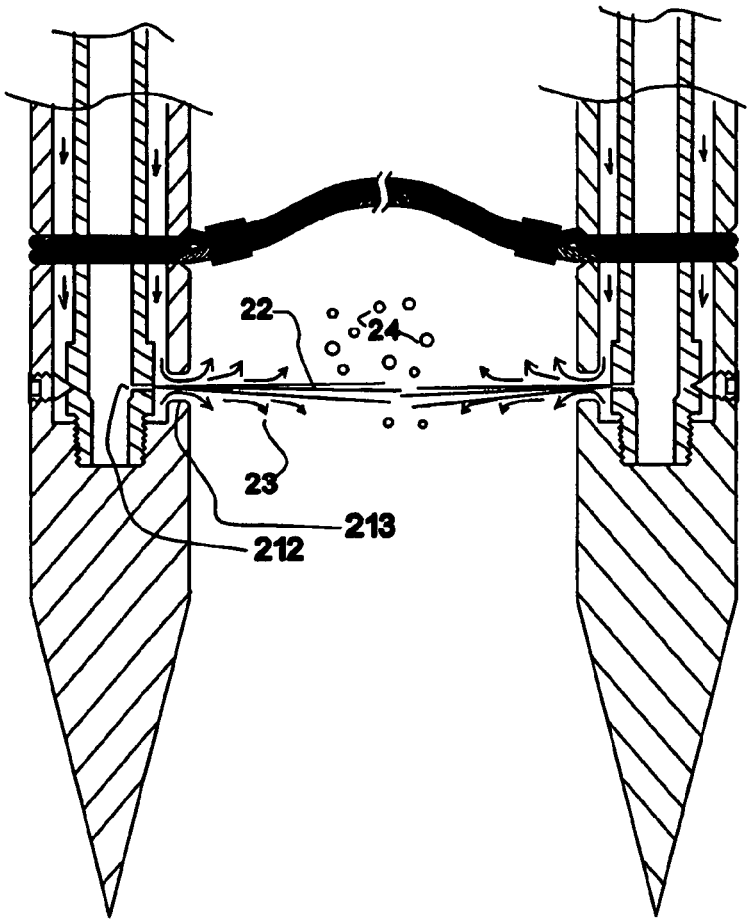
FIG. 5 is a schematic illustration of a pair of tethered jetting pipes with concentric pipes providing a concentric jet of compressed air to shroud a jet of grout in accordance with one embodiment of the present invention.

FIG. 5 is a schematic illustration of a pair of tethered jetting pipes with concentric pipes providing a concentric jet of compressed air 23 to shroud the jet of molten wax 22. The smaller center pipe delivers molten wax at high pressure while the larger annular area provides compressed air at much lower pressure such as that delivered by an air compressor.

Figure 6A:
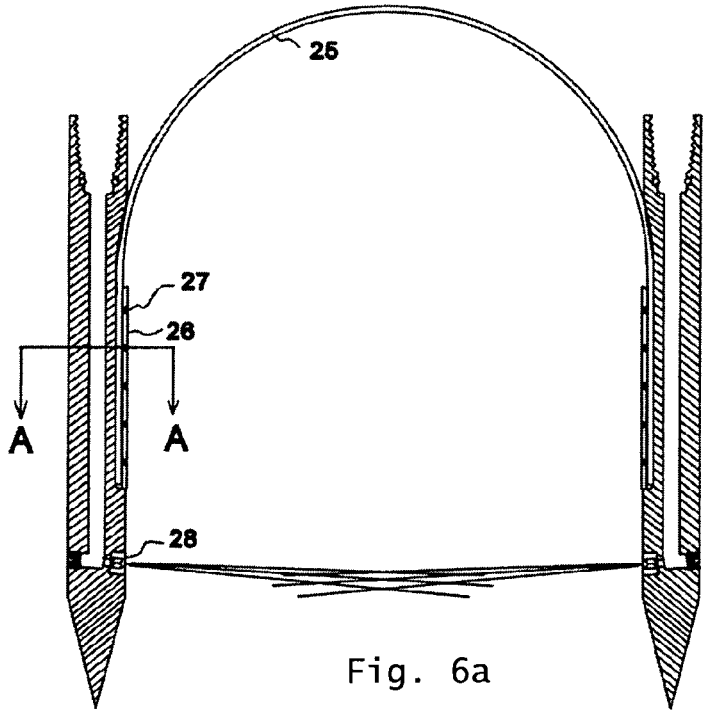
FIGS. 6*a* and 6*b* are schematic illustrations of a cable placed in a milled longitudinal groove that is covered with a welded plate in accordance with one embodiment of the present invention.
Figure 6B:
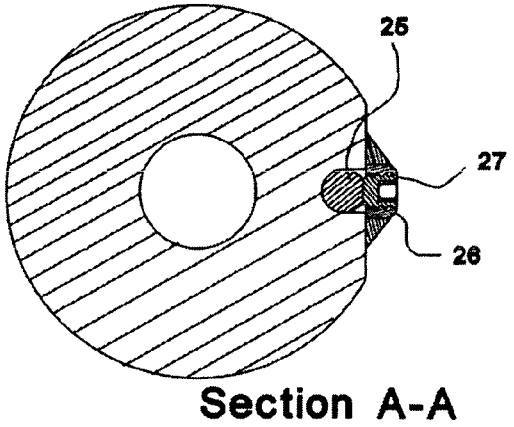

FIGS. 6*a* and 6*b* show another method of attaching a cable 25 fitted into a longitudinal groove on the outside of the pipe. The cable can be secured to the pipe in various ways, such as being capped with welded metal strip 26 containing set screws 27 that retain the cable. This allows an operator to insert the cable and tighten the screws to install a cable. This method secures the cable with minimal external break of the streamline of the pipe but may be less desirable since the cable can not pivot up and down. A replaceable jet nozzle 28 emits a jet of grout to at least partially cut a pathway between the two pipes while the cable completes the cut between the two pipes as they are driven downward.

Figure 7C:
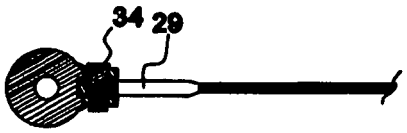
Figure 7C:
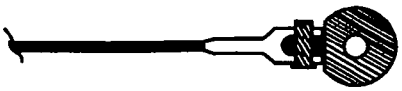
Figure 7C:
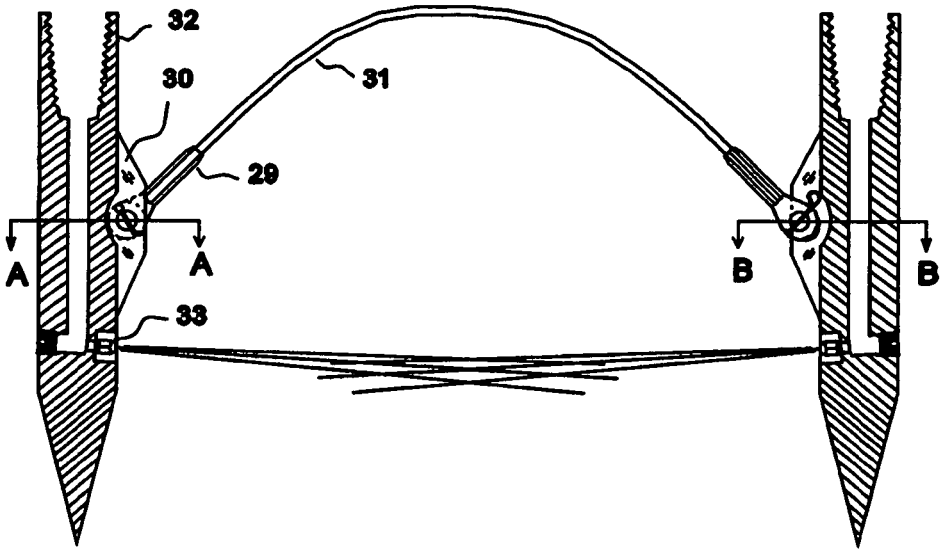

In FIGS. 7*a*, 7*b*, and 7*c*, the cable 31 having closed wire rope socket ends 29 is attached with a pin 34 to an open flange 30 that is welded onto the outside of the pipe 32 in section A-A of FIG. 7*a* or alternately an open wire rope socket is attached to a single flange by a similar pin in section B-B of FIG. 7*b*. Replaceable jet 33 is preferably oriented slightly downward to minimize splatter when the jet is above the surface. The attachment method of FIGS. 7*a*, 7*b*, and 7*c* has the advantage of being easily added to an exiting jetting pipe by welding on an attachment 30 or 33. This fitting is attached by pin 34 that allows the cable end to rotate up and down to avoid bending the cable as the jetting pipe reverses its direction of travel. The jet orifice is preferably located rotationally in line with the cable tether so that it is substantially directed at the adjacent jetting pipe so that it cuts a path for the cable. The unbalanced thrust of the jets 33 tends to keep the jetting pipes from moving too close together during insertion into the ground while the tether cable itself physically limits the maximum distance between the two pipes. An additional jet on the opposite outboard side may also be used but is less desirable when the pipes are tethered and because it tends to waste more grout. FIGS. 7*a*, 7*b*, and 7*c* show a much more robust cable attachment method using a standard cable eye of either of the two common types. It has a replaceable jet nozzle, desirably with a tungsten carbide insert, and is angled down a few degrees to prevent splatter of bystanders when pulling it out of a vertical hole. However when using molten wax grout, which has no solids, a drilled hole in the steel pipe provides an orifice that will last long enough to provide service; it may still be referred to as a jet nozzle or "jet".

Figure 8A:
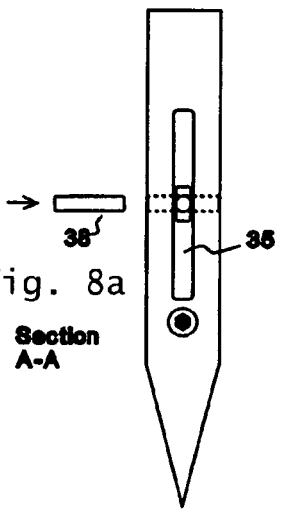
FIGS. 8*a* and 8*b* are schematic illustrations of a cable closed-end swaged end attached by a pin through a longitudinal groove milled into the jetting pipe in accordance with one embodiment of the present invention.
Figure 8B:
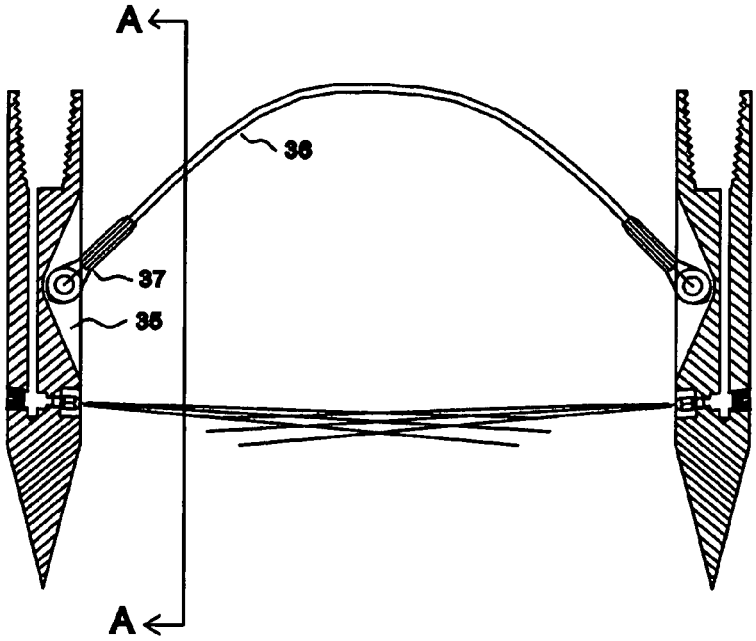

FIGS. 8*a* and 8*b* show another means of attaching the cable to the pipes. The cable 36, having closed wire rope socket ends 37 is secured within a milled slot 35 by a driven pin 38. This allows the cable to swivel up or down without kinking as the pipes are raised back to the surface after cutting through the soil. This design has no protrusions outside the pipe diameter, which may reduce the pipe driving force. FIG. 8*a* shows an external view of the pipe looking into the jet.

Soil resistance creates a force on the tether cable that may tend to force the path of the holes to deviate closer to one another than the intended path. The restraint of the tether cable also keeps the spacing between the pipes from becoming too wide. Pulling the pipes too close together may be minimized by unbalanced jet thrust as described above or by placing the tether cable further above the tip of the jetting pipe so that this force does not cause the jetting pipe tips to deflect from the intended parallel paths. The jet orifices may be located anywhere above or below the tether cable but preferably as close above or below (depending on the embodiment) as possible. In horizontal drilling applications, this would mean that the jet orifices are slightly further into the hole from the drilling rig. The conical points of the pipes may also be made slightly unsymmetrical, or pointing off center to cause them to tend to pull away from each other as they are driven into the ground. See also FIG. 4. Undesired deflection of the jetting pipe may also be prevented by pre-drilling the directionally drilled boreholes through the earth. Pre-drilling is most beneficial for horizontal directionally drilled boreholes to avoid excessive friction while moving the jetting pipes.

Figure 13C:
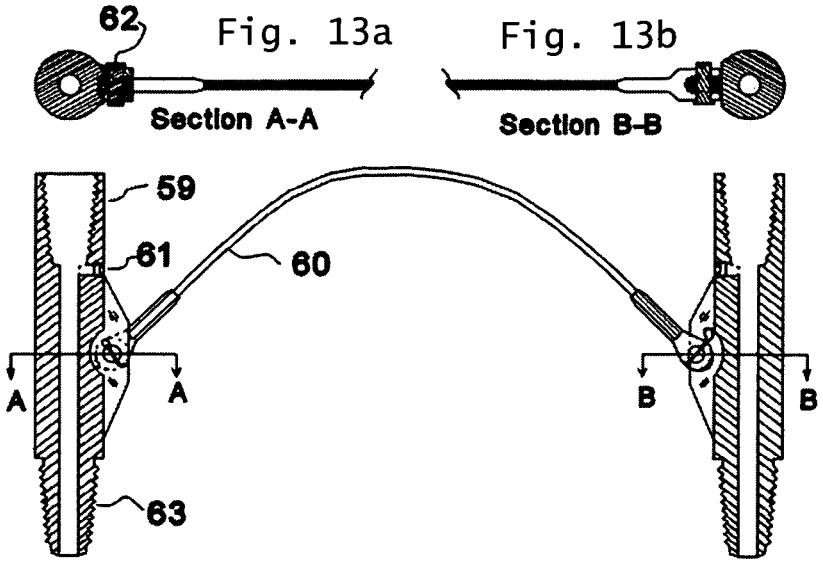

FIGS. 13*a*, 13*b*, and 13*c* show an embodiment of the cable attachment that may be used for the horizontal barrier concept when pre-drilled holes are used. This is why it lacks a point. It may be installed between any two joints of pipe. This allows the pipes to be pulled or pushed from either end to cause the cable to cut through the soil between pipes. This "cable sub" 59 has threads 63 at both ends like those of the pipes to which it will be attached. The cable 60 is attached by any suitable method but preferably one that allows the cable to pivot around a pin 62 up and down along the length of the pipe so that it can transition from push to pull without kinking the cable. The cable extends to the other cable sub attached to the other pipe. A port 61 on either side of the cable may optionally be used to inject grout at high pressure for jet assisted cutting of soil or at low pressure to fill the cut with grout.

Trench and Hole Formation

The holes are simply openings in the earth that allow the cable loop to be placed into position and pulled to cut through the soil. Depending upon the embodiment, these openings in the earth may be drilled boreholes, horizontal directionally drilled holes, or mechanically forged by driven pipe. They may be pre-drilled or formed in place. These openings allow pipes to be placed along edges of the desired section so that the cable can be pulled through the earth. The holes may be horizontal, vertical, or curve through the earth.

Horizontal basin-shaped barriers can be formed from a series of directionally drilled holes that angle down into the earth under a site and then back up on the other side of the site. When a cable or even a pipe is pulled through a curved pathway in the earth, it exerts a force against the soil perpendicular to its length. The magnitude of this force is a function of the total degrees of arc of the curve and the friction resisting the motion. When this force per unit area exceeds the shear strength of the soil, cable, or pipe, the cable slices through the soil. Many such holes or paths in a row may be joined to form a large barrier made up of many smaller panels or sections.

It is also envisioned that the hole could be replaced with an open or backfilled trench for the construction of certain horizontal barriers. The pipes could lie in two parallel trenches to produce the geometry to allow the cable to be pulled to slice through the earth between the two trenches. The trenches could be filled with heavy grout and as the cable is pulled, gravity would force the grout to flow into the horizontal cut.

Cutting the earth horizontally below the ground is possible but overburden pressure of the soil above a cut tends to close the cut and pinch out grout material that may be placed in the cut. Vertical barriers formed by excavating a cut in the earth also may close up due to lateral soil pressure from soil. To avoid this, the dimensions of the cut and the properties of the formation must be such that the pressure exerted by the formation is less than the mechanical strength of the formation along the cut. One approach is to make cuts small or narrow enough that they do not collapse and to fill them with material that hardens before cutting the adjacent area. Mining operations typically rely on the strength of the rock as well as mechanical supports to keep the cut open, but this is impractical in soil.

In forming horizontal barriers from a series of directionally drilled holes that arc under a site, the goal is to cut a pathway between the holes but it is desirable for the cut to follow the original path of the holes and not cut into the sides of the holes except at the point the cut between holes is being made. This may be accomplished by using a relatively small total angle of arc for the drilled holes and running a relatively large pipe in the holes so that its force perpendicular to the pipe never exceeds the shear strength of the soil. For example, the drill may enter the ground at 15 to 20 degrees from horizontal, descend to depth, and return to the surface at a similar angle. Having a high lubricity mud, such as bentonite based grout, in the hole further reduces the friction on the pipes and thus minimizes the force trying to straighten out the pipe and cut into the walls of the hole. The cable is relatively small in diameter compared to the pipes. The relatively small cable may pass through an arc of up to 180 degrees so that it has a relatively high level of friction and cuts into the soil.

Optional reciprocation created by upward movement of one jetting pipe while simultaneously moving the other downward will cause the tether cable to act like a cable saw and mechanically abrade any obstruction in the pathway.

A cable loop attached to two adjacent pipes may be used to cut soil like a knife without any assistance by jets. The process is very similar to the above descriptions of jet assisted cutting but differs in that the fluid grout may be applied with little or no pressure just to fill the cut formed by the cable as it passes through the soil. The fluid grout may also be applied from the surface through the same borehole as the pipes.

In one preferred embodiment, two vertical drilling units are placed side by side and a tether cable is attached between them that restricts them from rotating. The drill points are preferably angled such that they tend to move away from each other as the pipes are driven or vibrated into the ground, while the cable and its drag of cutting the soil tends to keep them together. As the pipes are driven into the earth, the cable cuts a path between the pipes which is hydrostatically filled by grout.

For the purpose of clear illustration and not as any limitation of the invention, it is envisioned that drill units with percussion drives or resonate vibration drives, known as "sonic drills," having over 40,000 pounds of net push down force working with 3" to 4" diameter pipe using a ⅝" diameter high strength cable with a minimum breaking strength of 40,000 pounds, would be used on a 10 foot spacing for cutting 500 psi maximum strength soil.

Pipe Characteristics

The term "pipes" refers to the elongated members in the holes without regard to whether the holes are pre-drilled or formed in place by driving or drilling the pipes into position. The "pipes" do not have to be hollow but could also be solid rod, I-beam, or flat bar made of metal or composite material. In vertical applications the pipes are pushed downward, but in horizontal applications where the hole returns to the surface at the opposite end, the pipes may be pulled from either end to cause the attached cable to slice through the soil. The pathway of the pipe is referred to as the "hole" without regard to whether the holes are pre-drilled or formed in place, or if they are straight or guided by directional drilling techniques, or if they are horizontal, vertical, or curve through the earth.

Many such holes or paths in a row may be joined to form a large barrier made up of many smaller sections or panels. Each new barrier section is formed with one pipe in a previous hole and one pipe in a new hole. Alternately, two sections could be formed with a gap between then and then a third section could be formed to join them using one pipe in each of the nearest holes of the previous section.

The jet grouting pipe or "jetting pipe" is essentially a pipe with a drill bit or just a pointed end that is mechanically driven into the ground with a percussive or direct push. Rotation of the pipe is not required. So, a rotary drill rig and high-pressure swivel are not required. One or more hydraulic hammers may be mounted on a truck, or an excavator machine as illustrated in FIG. 2*a*. Alternatively, the pipe may be drilled into the ground with conventional drilling techniques. The advance of the pipe may also be aided by a jet of fluid pointing substantially in the direction of the advance of the pipe. The advance of the pipe may also be enhanced by a mechanical or hydraulic drilling bit.

Cable Characteristics

The length of the tensile member (or tether cable) is based on experimental data or experience with the typical penetration distance in the soil at the nominal operating pressure and jetting pipe linear speed. The tether cable is preferably a steel wire rope cable strong enough to mechanically cut through soil and the pull back power of the pipe handling equipment is preferably strong enough to facilitate this action.

Figure 12:
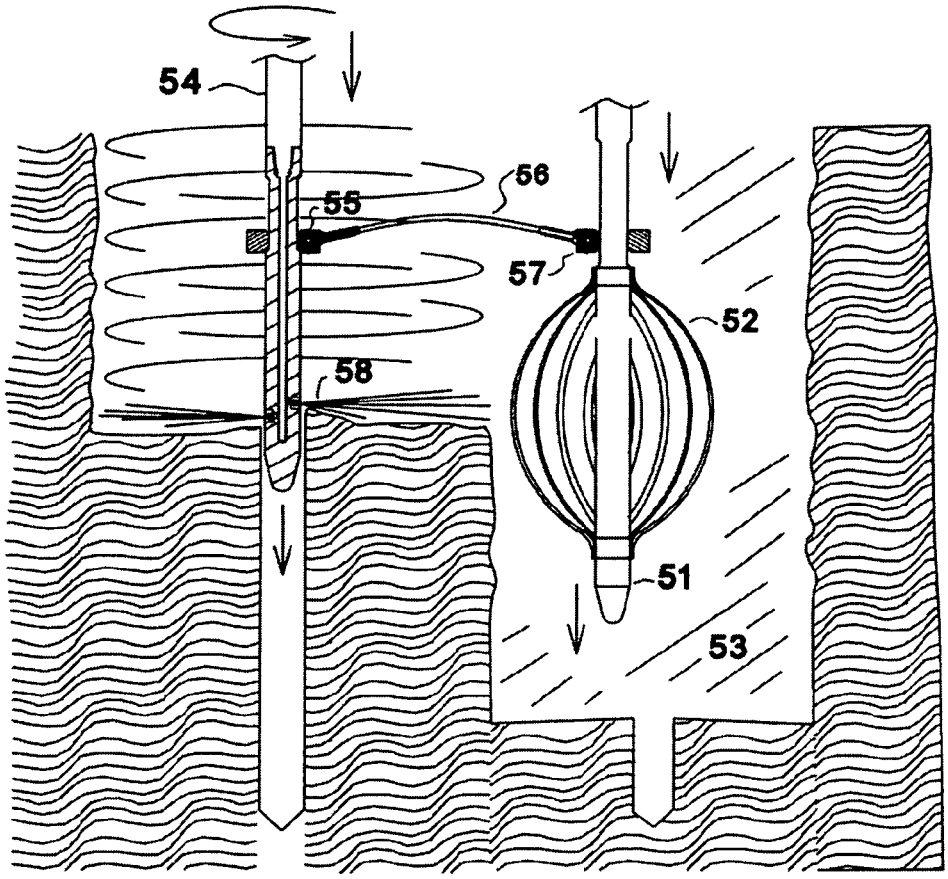
FIG. 12 is a schematic illustration of jet grouted column where spacing between columns is controlled by a tether cable in accordance with one embodiment of the present invention.

Jet Penetration and Grout Application (FIGS. 12 and 5)

FIG. 12 shows a means of applying the tether cable to interconnected jet grouted columns. The concept of attaching two jetting pipes together by a tether can also be useful in forming very deep interconnected vertical columns or columns along a curving horizontal path of pre-drilled holes or for holes formed by rotary drilling. In such embodiments, the tether cable attachment allows for rotation of the jetting pipes. The jetting pipes would be equipped with a rotating collar or ring that is free to rotate on the jetting pipe but is fixed to its position along the length of the pipe.

In FIG. 12, a cable or other tensile member 56 is used to attach a conventional rotating jet grouting pipe 54 to a second pipe 51 that has a centralizer spring 52 that is at least slightly smaller than the jetted column diameter 53 and so allows it to track down the previous hole that is filled with soil/cement or other grout mixture. Bearings 55 and 57 are able to move up and down within a limited vertical distance on the shaft as well as rotate to allow the jet grouting pipes to rotate freely without wrapping up the cable. The cable helps keep the pipes from getting too far apart and assures that the blast of the jets 58 cuts a complete pathway to the previous jet grouted column 53. Jetting is desirably performed on the way down rather than on the way up.

One method of attachment is comprised of a steel collar ring that fits loosely around a reduced diameter neck portion of the jetting pipe. Sealed bearings could also be used. The pipe would be free to rotate inside the ring and the cable would be attached to the ring. Since the jets on a rotating pipe form a column of much greater diameter, the attachment means and the collar itself may optionally be larger diameter than the pipe. A tether cable is attached to the collars of both pipes even if only one of the pipes rotates. The tether cable may be a wire rope cable, chain, spring or even a rigid bar member. As described above, the tether cable limits the separation distance between the pipes and also prevents further downward movement if the soil between the pipes has not been disturbed and mixed with the grout to form a continuous wall. The tether cable does not have to be a flexible cable but could also be made from a rigid rectangular steel plate oriented vertically with a tube welded parallel along two opposite vertical sides. The two jetting pipes extend vertically through the parallel tubes with sufficient clearance to allow free rotation. This has the advantage of simplicity and restricting the pipes from coming too close together. Like other tethered pipe concepts described herein, this method requires at least a narrow cut, for the tether cable, to extend completely to the surface.

In another variation on this tethered pipe method, a pilot pipe 51, with centralizing 52, or edge guiding means, such as bow springs or simply a bent end, is lowered into a previously formed jet grouted column 53, while tethered to a jetting pipe 54, that is lowered in to a pre-drilled hole or forced into the ground, while ejecting grout at high pressure and rotating as it descends into the ground. A tether cable 56, which allows at least the jetting pipe to rotate, connects the two pipes. The connection to the jetting pipe 55, allows the jetting pipe to rotate freely, while preventing the cable attachment from moving along the axis of the pipe. The pilot pipe 51 does not have be able to conduct fluid or rotate so it may be little more than a heavy steel bar that is simply lowered into the unsolidified column by a winch line from a drill rig. The pilot pipe centralizer springs may be smaller than the size of the jetted column so that it rides down the nearest side of the formed column.

As illustrated by FIG. 5, the soil cutting penetration distance of the jet blast in accordance with various embodiments of this invention may be increased by introducing air into the fluid near the jet nozzle as is known in the art of two phase jet grouting. Penetration distances of over 10 feet have been achieved with traditional cement grouts. The air may flow from a concentric nozzle 213 shrouded around the molten wax nozzle 212 to form a boundary layer of air 23 around the jet of molten wax 22 to reduce friction of the molten wax with the soil/wax mixture. The greater penetration is also at least partially a result from reduced mass, due to the entrained air 24, of the soil/wax mixture that the jet must pass through to reach the soil face. When using molten wax grout, this air is preferably heated air or even engine exhaust. The penetration of the jet may also be enhanced by straightening the flow stream of the molten wax just ahead or and through the jet nozzle to reduce fluid turbulence which causes the jet blast to disperse more rapidly upon exiting the jet nozzle. Larger diameter jets and higher pressures also increase penetration distance. Examples of suitable fluids include delayed set cement based grout or pre-hydrated bentonite slurries with additions of sand, hematite, or barite weighting agents to achieve the desired density.

Jet penetration distance may also be increased by heating the molten wax above the boiling point of water before injection. The high temperature wax then causes water in the soil to boil and produce steam that reduces the density of the soil/wax mixture in the path of the jets, allowing the jet to penetrate further due to a reduction in density of the grout soil mixture. The higher temperature of the wax also increases the permeation distance that the wax can reach into the undisturbed soil. Instant heater systems may be positioned between the molten wax tanker and the injection point to add more heat to the molten wax. The wax coming from the tanker truck will typically be less than 200° F. so the instant heaters may be used to heat the wax to temperatures between delivery temperature and the typical 500° F. flash point of the wax to maximize the heat transfer to the ground or to cause boiling of soil moisture.

The permeation effect is believed to occur even in wet or very low permeability soil formations. Since this adjacent soil is mechanically undisturbed it will have a greater density of soil particles than the interior of the panel and it should be firmer and more dimensionally stable. The permeation distance into the undisturbed soil may be increased by measures that increase the total thermal energy introduced into the soil. The primary way of increasing the total thermal energy is to slow down the vertical movement so more molten wax is introduced through the panel, thus depositing more heat, even though this may cause more excess molten wax to be returned to the surface as waste. Another way to do this is to pre-treat the soil with hot water, hot air, or steam. Performing the jetting operation with hot water also pre-cuts a pathway through the soil, making it easier for the jet of molten wax to blast through the soil while also warming the soil so that the wax will penetrate further.

Non-rigid earth materials like soil will exert some lateral force tending to close vertical cuts through the earth. However, if the cut through the soil is filled with a sufficiently dense fluid grout or clay slurry material, the hydrostatic pressure of the fluid helps balance the lateral earth pressure and keeps the cut from closing. Pressurizing the grout at the surface can also supply this needed balancing force but is less preferred because if the fluid finds a leak path and escapes, the hole could collapse. Examples of suitable fluids include delayed set cement based grouts or pre-hydrated bentonite slurries with additions of sand, hematite, or barite weighting agents to achieve the desired density.

Another approach is to fill the cut with a fluid that permeates into the surfaces of the cut and fills all the voids and makes that surface impermeable. Even when the cut closes up, the impermeable surfaces will form a barrier. This may be done with materials such as molten thermal permeating wax grout such as WAXFIX™ 125 made by Carter Technologies Co. of Houston, Tex., polyacrylamide gel grout, such as AV100™ from Avanti International, or with common sodium silicate gel grouts with a suitable generic time delay activator, such as mild acid or sodium acid pyrophosphate. A surfactant may be present in the grout. Of these, the molten thermal permeating wax grout is preferred because it penetrates into soil further and more uniformly since its permeation is controlled primarily by thermal heat loss instead of only the native permeability of the soil.

Regardless of the type of fluid grout utilized, it is generally desirable that the grout be delivered to the cut immediately as the cut is formed, so that the cut does not close up before a barrier can be formed. One way to do this is to have a continuous hydrostatic column of the fluid grout from the area of the cut, back to the surface along the pipes. The fluid grout may also be conveyed through the pipe itself and discharged to the area of the cut, preferably very near where the cable attaches to the pipe. If the fluid is conveyed under sufficiently high pressure, 2000 psi to 10,000 psi, and discharged through a small orifice known as a "jet", then the fluid grout may also be utilized to apply useful cutting energy to help cut a complete pathway between the pipes. Jet cutting with the fluid grout produces a "cut" that is filled with a fluid slurry mixture of soil and grout. Generally more fluid grout is utilized to perform the cutting than can actually fit in the interstitial spaces or voids between soil grains so the excess soil/grout mixture flows back to the surface as waste. Molten wax is more expensive than traditional grouts. So, when using molten wax grout, this waste is desirably captured and recycled by removing the soil and re-heating the wax for re-use.

The fluid grout may be delivered under pressure or it may be of sufficient density that its hydrostatic head alone provides sufficient force to keep the cut open. Relying on density is preferred for horizontal barriers because sealing the grout into the cut is not required. In the case of vertical barriers, the fluid grout only needs to supply a portion of this force since the ground generally has some lateral strength. However for horizontal barriers, to float the overburden soil by relative density alone, the grout density must generally be denser than the soil material. Note that if portions of the land surface are mounded up above the perimeter grade, higher grout density might be required. If the site to be contained is a depression or contains a body of water, a reduced grout density may be sufficient. The fluid grout may alternately be a permeating substance, such as molten wax, that soaks into the sides of the cut and makes the soil impermeable even if the cut closes.

In addition to positively verifying the continuity of the adjacent panels with the attached cable tethered between the pipes, an improved grout material may be used. Molten wax grout is more impermeable, can tolerate earth movement, and can also reduce the permeability of adjacent soil not actually disrupted by the jets. Molten wax grout can also prevent defects in the barrier caused by collapse of soils and pinch-out of the grout.

In some embodiments the "cut" or "path" may be formed by cutting action of the cable combined with hydraulic cutting from high pressure jets. These jets may do their cutting with water but are preferably cutting with a fluid grout that will also form the barrier.

The pressure in the jetting pipe is preferably between 2,000 psi and 50,000 psi but may be higher or lower for various applications. Due to the lower density of wax relative to cement slurries, higher pressure is required to achieve the same energy transfer. The molten wax exits the jet nozzles with high kinetic energy and disrupts and erodes the soil in its path out to some distance. As the drill pipe is moved into or out of the ground without rotation, the blast from the jet nozzles form a wall-like panel of wax plus disturbed soil material that may extend many feet away from the drill pipe. The molten wax permeates the soil along and adjacent to this panel and also encapsulates solid objects in this path such that the thickness of the wax permeated panel is significantly thicker than the path cut by the jet blast. The wax tends to permeate into the soil until it cools and solidifies. Common tanker trucks can deliver molten wax at up to 200° F., and an optional electric instant heater unit can heat the flow to 300° F. to 400° F. to increase heat available, thereby causing increased permeation of the wax into the soil.

A pressure head of molten wax grout may be maintained in a shallow trench at the surface to prevent collapse of the panels due to lateral ground pressure and to prevent ground water from displacing the wax upward before it solidifies. In areas where the water table reaches to near the surface, the surface may be elevated with fill dirt or a surface pipe installed to above grade, to assure that the hydrostatic head of the molten wax is at least equal to the groundwater head throughout the jetted panels. The surface pipe may be jammed into the top of each hole and then topped off with molten wax after placing cold soil over the base of the pipe as a seal.

Alternately, chilling means, such as metal plate or a pipe carrying cold water, could be used to solidify the upper few feet of the cut as a seal. While pressure may be used to maintain the hydrostatic head, it is also possible to use one or more weighting agents such as barite, bentonite, dry Portland cement, silica fume, or hematite mixed with the wax to give it a greater density so that pressure and surface sealing of the cut are not required. Wide variation in particle size between 10 microns and 0.05 micron might be used. Suspending agents such as long chain polymers may also be added to the wax, but these impact permeation qualities of the wax.

In various embodiments, the jetting of the panels may be performed on the way into the ground or on the way out of the ground, or both on the way in and the way out. With the attached flexible tensile member, such as a cable, jetting must be performed at least on the way in to the ground.

Grout

Forming thin diaphragm wall barriers using jets of molten wax often combines aspects of permeation grouting with those of jet grouting and also with mechanical cutting. Such wax-impregnated walls use only a fraction of the volume of molten wax required for making joined columns so they are more economical. The permeation qualities of the grout allow the wax wall to surround and encapsulate obstructions that block the jet blast. Note that herein the term "molten wax" means wax that is heated above its melting point and not ambient temperature emulsions of solid wax in a water or bentonite slurry. The preferred molten wax is a malleable plastic solid at ambient ground temperature and can deform to earth movements without cracking but also has the ability to permeate into all types of soil. In certain embodiments, it may be desirable to chemically modify the wax to have surfactant properties that allow it to mix with wet soil and displace water. The permeability of the preferred wax is several orders of magnitude lower than cement and bentonite based grouts. Thus, a thin barrier of an inch or two thick may equal or exceed the hydraulic performance of a 2 to 4 foot thick barrier made of cementitious jet grouted columns.

A molten wax comprising paraffin, petrolatum, alpha olefins, ceresin, ozocerite, (ozokerite) and montan lignite coal derived wax, plant leaf wax, bees wax, polyethylene, hot melt glues, or other waxes or blends of waxes that undergo a distinct phase change from solid to a liquid at a temperature between 90° F. and 220° F. and which have a viscosity of less than 300 centipoises at 200° F. are desirable. Waxes are characterized by distinct melting points rather than a gradual softening over a wide temperature range as in tar or bitumen. The preferred wax is malleable at typical ground temperatures 50° F. to 70° F., a low viscosity liquid at temperatures above 180° F.

As described, molten wax may be chemically modified to give it surfactant properties that improve its ability to displace water and mix with wet soil. The surfactant properties change the contact angle and wetting characteristics of the molten wax to soil and generally enhance wicking penetration of the molten wax into a damp or water-wet soil. There are many chemical additives capable of modifying the surfactant properties of molten wax that are known in the art of dyes, printing, and coatings. Permeation of molten wax into earthen materials is governed by thermal heat transfer, viscosity, and capillary action wicking properties. Unlike chemical grouts, the molten wax continues to permeate into a soil until heat loss causes it to cool to its congealing temperature and become viscous. Molten wax has a viscosity comparable to light hydrocarbon liquids such as gasoline or diesel fuel. In a pre-heated soil, molten wax continues to permeate through soil for a very long time thus greatly increasing the distance it can travel.

The molten wax may also be blended with one or more finely divided filler materials, such as bentonite, fine sand, Portland cement, or fumed silica to reduce its cost and increase the density of the wax. Another means of doing this is to pour pre-heated particulate materials into the panels as soon as the jetting pipe is withdrawn. This is potentially useful in a vertical barrier where the particles falling to the bottom of the barrier panel help to mechanically keep the cut open. The higher density of the molten wax slurry may be useful in hydraulically preventing soft soil from closing up and displacing the molten wax back to the surface. Higher density wax may also be useful in water saturated soil to prevent water from intruding into the wall.

In various basic embodiments of the present invention, the molten wax mixes with in-place soils and becomes continuous phase binder material filled with soil particles. Grout slurries containing particulates, such as cement, may require very special abrasion resistant high-pressure pumps. Using pure phase molten wax with no solids added allows the use of less-expensive, high-pressure pumps that are designed for high-pressure water service up to 50,000 psi. The lack of solid particles reduces wear and also helps prevent plugging of the jet orifices.

The grout may be an engineered material such as pre-hydrated bentonite slurry filled with sufficient hematite to obtain the required density and that cures to form a barrier material. Such a grout may gradually lose water to the soil over a period of many months becoming more viscous and impermeable over time but always retaining a degree of plasticity. The grout may also be modified with additives that decrease its vapor pressure and change the water loss equilibrium point to cause the grout to remain moist even in a dryer soil.

Also, jetting with conventional cement grout in this configuration requires constant attention because jet nozzles tend to plug frequently with cement solid, or debris from hoses and pumps. Molten wax is a true liquid and contains no particulate to plug the jetting nozzles or cause wear on hoses and pump seal packing. This may increase reliability and allow use of lower priced or higher pressure pump systems that do not have to handle abrasive particulate grout.

Grout for Landfill Horizontal Barriers

Grout for landfill barriers may be selected based on several factors. A special high specific gravity drilling mud is made with a high concentration of pre-hydrated premium Wyoming grade bentonite and is actually a barrier grout with a very low permeability. In its semi liquid state, the grout actually forms an active hydraulic gradient barrier. Its fluid is under a hydrostatic force trying to force its fluid into the formation above as well as below the barrier. Over a period of several months the mud will give up some moisture to the ground and become more and more viscous until it reaches the consistency of peanut butter. The permeability of the grout will also decrease significantly as this equalization process proceeds and can easily reach $1\times10^{-9}$ centameters per second.

If a landfill contains lots of chlorinated solvents, the grout could be modified with significant amounts of zero valance iron. This will react with the solvents and cause a de-chlorination reaction much like the permeable reactive barriers now used for groundwater remediation. However, because the permeability of this barrier is very low, the iron will not be used up but will continue to perform for hundreds of years.

Monitoring and Calculating Bottom Barrier Thickness

Figure 17:
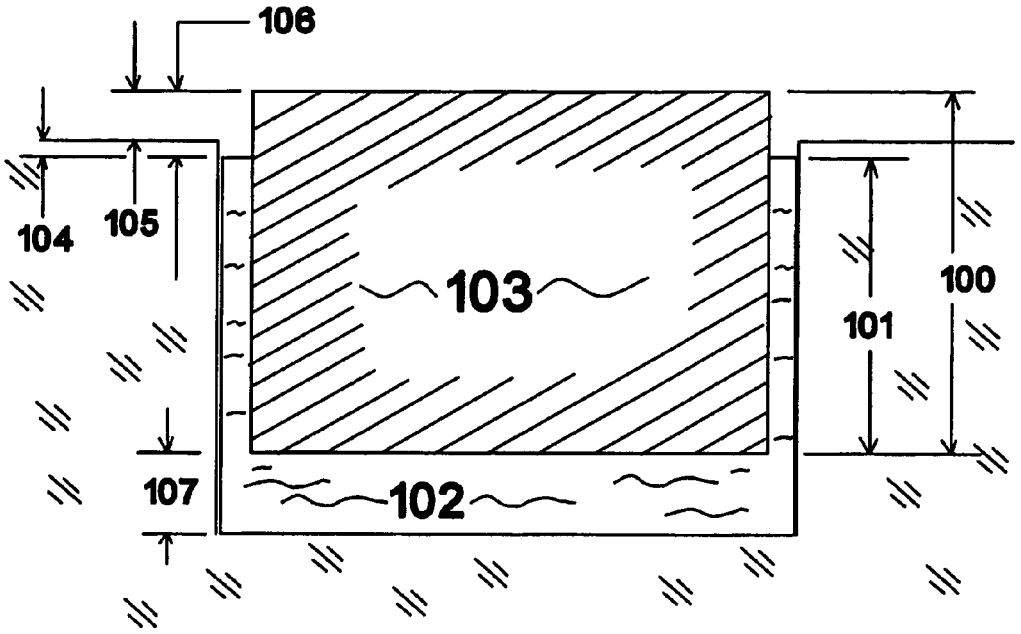
FIG. 17 shows a floating soil block illustrating the method of predicting the buoyant lift achieved with a given grout density, soil density and trench fill level in accordance with one embodiment of the present invention.

FIG. 17 describes the method of calculating the bottom barrier thickness at a specific point based on the relative density of the grout versus the soil, the fill height of the trench and the depth of the bottom cut. Standing at the ground surface, a topography observer can not actually see the submerged thickness of the block ($T_s$). In FIG. 17, the difference between the thickness of the block ($T_b$) and the thickness of the submerged portion of the block ($T_s$) is equal to the bottom barrier thickness ($T_{BB}$) plus the "freeboard" (F) or depth from ground level to the fluid in the trench.

The bottom barrier thickness $$T_{BB}=[T_b-\{(D_b/D_g)\times T_b\}]-F$$

The following reference numerals refer to dimensions illustrated by FIG. 17.

100=$T_b$=the vertical thickness of the block of earth

101=$T_s$=the vertical thickness of the portion of the block of earth submerged in the grout

102=$D_g$=the density of the grout

103=$D_b$=the density of the block of earth

104=F=Freeboard (Elevation of original surface above level of grout in the trench)

105=$T_{BB}$=Thickness of the bottom barrier

106=F+$T_{BB}$=Elevation increase of the soil block due to buoyancy

107=$T_{BB}$=Thickness of the bottom barrier

Note that 107 and 106 are always equal.

The thickness of the mud layer at any given point is a function of the density difference between the mud and the landfill soil times the depth of the cut at that point. Therefore the mud layer is much thicker under the middle of the landfill, where it is needed most, and becomes thinner at the edges where the HDD holes curve back up to the surface and along each side. Many landfills also have soil mounded up in the central areas. The extra weight of this above grade soil will reduce the thickness of the barrier in this area. In the example, assume the soil is mounded up 10 feet above grade and has a bulk density of 105 pounds per cubic foot and that the grout has a density of 131 pounds per cubic foot. The extra 10 feet of earth above the 60 foot deep barrier makes the soil block 70 foot thick at the point we are evaluating. If we fill the trench to within 3 feet of the surface, the barrier thickness at this point is 0.89 feet.

$$\text{Thickness of bottom barrier}=T_{BB}=[70\text{ ft}-\{(105\text{ pcf}/131\text{ pcf})\times 70\text{ ft}\}]-13\text{dt}=0.89\text{ ft}$$

Nearer the edges where the barrier is only 20 feet deep and the surface is at level grade $$\text{Thickness of bottom barrier}=T_{BB}=[20\text{ ft}-\{(105\text{ pcf}/131\text{ pcf})\times 20\text{ ft}\}]-3\text{dt}=0.96\text{ ft}$$

By filling the trench with more grout, this bottom barrier thickness increases the by the same elevation. The above equation may be used in a simple spreadsheet program to analyze many points based on the initial topographical survey to properly design the depth profile of the horizontal directionally drilled holes before construction. This design step will allow the user to achieve the desired uniform barrier thickness.

If a site's natural elevation slopes from one side to the other, the uphill side can not be filled all the way to the surface without overflowing the downhill side. It is necessary to compensate for this extra weight on the uphill end since the landfill will essentially be floating on the grout. One way to do this is to make the depth of the original HDD holes, and therefore the soil cut, significantly deeper on the uphill side to compensate for surface elevation and any cap above grade. This helps the block of earth to float level and have a relatively uniform bottom barrier thickness. This can also be calculated from the same equation above. Alternately, the elevation change from one side of the site to the other may simply be eliminated by re-shaping the surface to achieve a uniform perimeter elevation before work begins.

Using Pressure Instead of Grout Density in a Horizontal Barrier (Additional Embodiments)

Constructing a horizontal barrier under an existing landfill may also be performed using lower density grouts such as cement/bentonite grouts by pressurizing the grout. The motivation for this would be that high density grouts are relatively expensive and cement/bentonite grouts, which contain lots of water, are relatively cheap. The process for forming the barrier is essentially the same except the liquid barrier cannot extend back to the surface without some sealing means at the surface.

The directionally drilled holes are installed under the site to form the profile of the bottom barrier just as in the method with high density grout. A trench excavated along the same side of the site intersects the path of the directionally drilled holes at a depth of 10 to 20 feet and branches from this trench extend outward along the pipes. The short subs with the attached cable are attached to the ends of the pipes and laid in the bottom of the trench along with a small amount of dense fluid grout. A sealing means, such as a rubber wiper or stuffing box apparatus, is installed around the pipe outboard of the short sub. This apparatus provides a seal to prevent grout from flowing up the outside of the pipe to the surface. The trench is then backfilled with a soil/cement mixture which will harden to at least the strength and permeability of the native soil by the next day. On the opposite side of the site the exit holes are prepared with a cemented casing and a similar annular sealing means to retain pressure on that side of the site.

After the backfill has hardened, the pipes are pressurized with the cement/bentonite grout and moved through the holes to pull the cable loop through the soil under the site, stopping before pulling out of the ground on the other end. After the cut is complete, the surface topographic survey is performed and soil is re-contoured as needed to produce the desired barrier thickness. Grout pressure is also adjusted to obtain the desired barrier thickness. Grout pressure is typically less than 1 pound per square inch per foot of depth. The pipes and cables are left in place at least until the grout hardens.

A simpler technique that avoids having to dig the open trench may also be feasible and more cost effective. In this alternate method, the pipes and cable attaching subs are placed as in the dense grout method. However the pipes are coated with a thick layer of viscous lubricant such as petrolatum or grease. The holes are filled with a cement/bentonite grout that will harden overnight to at least a soil-like strength. The cable is pulled into the ground a short distance and the grout is allowed to harden. The next day the cable is pulled under the site to form the cut, but stopped before the cable comes near the ground surface on the other side. As the cable is being pulled, the cement/bentonite barrier grout is injected through the pipe exiting the orifice near where the cable is attached and flows into the cut path as it is made. The viscous lubricant coating on the pipe allows the pipe to move but provides a low pressure seal against escape of the grout. The grout is injected under enough pressure to keep the cut open and support the overburden weight of the soil above. This pressurized grout will have different lift characteristics than the dense grout because its pressure increase with depth will be only half as much per foot as a grout that is twice as dense. The portion of lift force generated by pressure is independent of depth so soil over a shallow cut will lift as much as soil over a deeper cut. However a least a part of the lift still comes from buoyancy of the grout, even when the grout density is insufficient to float the soil by itself. Therefore a designer may select the best combination of grout density and pressure to achieve the desired uniform lift characteristics.

An example of the low cost cement/bentonite grout that could be used in the above method would be a pre-hydrated bentonite slurry with small additions of cement and slag cement with sodium lignosufonate additives to reduce viscosity. Properly formulated slurry may have a set time of 8 to 24 hours and cure to a 50 psi compressive strength with a permeability of $1\times10^{-7}$ centimeters per second.

Also, the pre-drilled holes could be drilled with bentonite or other standard drilling mud types, or formed by direct push methods, or could be a dry hole drilled with air. If the holes are filled with drilling mud, this fluid would be rapidly displaced out of the hole by the molten wax. The molten wax would cool and partially solidify on contact with the mud and form a plug at the interface to help sweep the mud out of the hole.

Additionally, the tether cable can optionally be used as the primary means of cutting the pathway between two adjacent holes. The jet nozzle could be positioned to trail the tether cable rather than lead it. The grout could then be pumped into place or applied to fill the void formed by the passage of the tether cable. The molten wax or other grout materials could even be pumped into the open hole around each pipe rather than being pumped down the pipe. Sufficient pressure head could be applied to the grout to prevent closing of the pathway due to lateral soil pressure. Applying dense grout from a surface trench minimizes complexity in forming the barrier with pressurized grout but the higher cost of the grout may outweigh this advantage in some cases.

Landfill Application

The method of the present invention may be applied to construct a simple pre-hydrated bentonite grout barrier under a hypothetical existing municipal landfill site that is roughly 400 feet by 600 feet situated in a geologic setting of sandy soil with few rocks larger than 6 inches. All references to dimensions are for example and clear understanding only and do not constitute a limitation to the invention or a preferred embodiment. The method of this embodiment begins with preparing a row of horizontally directionally drilled (HDD) boreholes under the site entering the ground, at a 15 to 18 degree angle from horizontal, to maximum depth of 60 feet and then curving back toward the surface to exit at a similar 15 to 18 degree angle as in FIG. 11. The boreholes are roughly parallel to one another as in FIG. 12 but could easily vary from 20 to 40 feet apart in a shallow arc under the landfill of about 36 degrees of total arc. The holes begin in a shallow ditch on one side of the site. The holes are drilled to a diameter of 8 inches and stabilized with high specific gravity weighted drilling mud, which is also the grout that will form the final barrier. The specific gravity of the mud is nominally 20 percent greater than the average density of the soil. The drilling mud may be circulated through the holes by adding mud to the HDD holes on one side and letting it flow through the holes to the other side. After each hole is made, four inch diameter steel pipe is left in each hole. The pipe is preferably a uniform outer diameter throughout its length to minimize friction when pulling the tubing through the curved hole. HYDRIL™ external flush joint oil well drill pipe, tubing, and casing is an example of this kind of threaded connection and comes in approximate 30 foot lengths. The pipe is used to pull additional pipe into the hole as needed and will also have the cable attached to it to make the cut.

A catenary length of high strength wire rope is connected by means of a "cable sub." This is a special tool joint similar to FIG. 13. This cable sub is connected in each of two adjacent pipes outboard of the hole. The cable sub is a short pipe similar to the 30 foot pipe, having pin threads on one end and box threads on the other, and may optionally have a grout delivery orifice near the cable attachment point. The connection point is designed to allow the wire rope to swivel longitudinally to the pipe without damage when the pipe movement is reversed. Stationary winches or mechanical apparatus, such as a rack and pinion drive like those of a horizontal directional drilling rig, pull the two pipes through their holes such that the wire rope slices through the soil between the two HDD holes. An example of a suitable drilling machine is the DD-210 made by American Auger Company. This machine can exert a pulling or pushing force of over 200,000 pounds. As the cable slices through the ground, gravity forces the high specific gravity drilling mud to flow into the cut and provide a buoyant lifting force to expand the pathway that was created by pulling the cable through the pathway. Sections of the pipe are continually removed from the exit end and added to the entry end. Therefore, the pipe always remains in the HDD holes even after a cut is completed. This process is then repeated with the next adjacent section using the same pipe from one side and the next pipe from the adjacent hole. The pipes are pulled one or more pipe sections at a time.

The four inch pipes in the holes bear against the 36 degree arc curve of the HDD holes but do not have enough force to cut into the soil due to their greater bearing surface area and the relatively small contact angle. The lubricity of the drilling mud also helps the pipes slide along in the hole easily. However the wire rope cable catenary loop has a 180 degree contact angle and is under sufficient tension that it will slice through the soil. Typical pulling force on ¾" diameter wire rope cable would be about 15% to 80% of the cable minimum breaking strength or about 15,000 to 80,000 pounds force. Rocks in the path of the cable will be broken or pushed out of the way according to the strength of the rock versus the resistance of the soil surrounding it. Very hard soils combined with very large rocks may require larger stronger cables and winches. A 1¼" diameter cable with a strength of 158,000 pounds may be needed. The spacing between pipes may also be adjusted. If a cable breaks in service another one is installed on the pipes and pulled through again. It can even be pulled through the opposite direction if desired. Alternating pull on the pipes can create a sawing action on an obstruction. If cable slicing or sawing alone can not break through the obstruction, jets on the pipes could be drawn to the point of the obstruction and activated to cut through the obstruction. In slicing through the soil, a steel cable is theorized to work much like a cheese slicer wire cuts through cheese. Unlike a sawing action, no waste or cuttings are produced by slicing.

After many joined sections are cut, the landfill has a bottom barrier layer of heavy mud under it, which is really a slow setting grout, that rises to near the surface on two ends but the sides are still uncut and unsealed. To complete the basin, additional HDD holes, at progressively more shallow depth, are installed to extend the sides up to near the surface as in FIG. 12*b*. Additional vertical or steeply angled barriers may be installed if the sides of the horizontal portion of the barrier are not to be extended back to the surface due to access constraints. These vertical side cuts may be formed by essentially the same method with one pipe in the outermost directionally drilled hole and one pipe placed in a trench at the surface. Pulling the pipes then pulls the cable in the same way as for the other sections. For a pipe that needs to be relatively near the surface, a trench is perhaps more economical than another directionally drilled hole. Optionally, this last section could even wait until after the bottom barrier grout has fully cured and is no longer able to flow.

High density fluid grout may be used not only to keep the horizontal cut open but also to expand it by floating the overburden soil upward from its initial position. Operators would try for an initial mud layer thickness of a few inches during the cuts. The thickness of the layer of high specific gravity drilling mud is easily measured by performing a topographic survey from pre-installed markers on the surface of the landfill. The thickness of the layer of mud increases by the same distance as the elevation increase. Soil is then re-contoured to achieve as uniform as possible an elevation change in the landfill. Note the landfill soil above the horizontal cut is floating on the dense mud. After this step is complete, the level of the mud in the ditch may be increased as desired, which increases the thickness of the mud layer and raises the entire landfill much like a rising tide lifts all boats equally. In most cases the heavy bentonite grout several inches thick will provide a sufficient long term barrier, but in some cases it may be desirable to augment this barrier with synthetic liner material such as high density polyethylene extrusion (HDPE). With the landfill floating on the high density fluid grout and the pipes still in place it should be possible to draw strips of the liner material into the pathway of the barrier. After several adjacent cuts have been made and the bottom barrier grout increased to a significant thickness, sheets of liner may be connected at multiple points to a catenary cable loop. The liner is preferably corrugated slightly along its length so that it can tolerate changes in the spacing between the pipes as the cable flexes. The liner strip is rolled up suspended over the trench or laid in the trench. The connected cable loop is attached to the pipes and pulled through the fluid grout under the site. The liner strips are preferably a little wider than the pipe spacing behind the cable loop so that they overlap at the edges. The grout produces a seal between these overlapped edges. If desired, a wider sheet of liner material may be pulled into position using only every second pipe to achieve 100 percent overlap of the sheets.

Experimental Friction Tests

Friction of the cable passing around the curve of the cut increases exponentially with the total contact angle and the coefficient of friction. The friction factor is an exponential function of the angle of contact with the soil times the coefficient of friction. The drag friction is the weight of the cable laying horizontal on the ground times the coefficient of friction. This drag friction subtracts from whatever cutting force remains after applying the friction factor and for very wide cuts can cause it to fall below zero, indicating a stuck cable.

$$\text{The Pounds Total Friction}=e^{\lambda\cdot\alpha}+W_h\times\lambda$$

Where $\lambda$ is the coefficient of friction and $\alpha$ is the angle of contact in radians and $W_h$ is the weight of the cable laying on the ground surface and in a horizontal cut.

Because of the complexity of friction between surfaces, such as steel cable and soil, are not historically well known these equations were tested. A test sled with steel cables for runners was built, loaded with various weights and pulled through three different soil types, both dry and wetted with a three different types of grout. Recorded friction coefficient values ranged from 0.5 to 1.0 and the above equation was demonstrated to predict field results.

Another field experiment was done in which one-inch diameter steel cable was placed in a 24 foot wide, arc-shaped ditch and pulled with instrumented dozers to measure the force required to slide the cable across the soil and also to shear the soil. The dozers were equipped with wireless remote-reading digital load cells. The friction loss was also measured at various contact angles and in both direct shear, or "slicing," where both dozers pulled in unison, and also by holding a measured resistance with one dozer while pulling with the other to generate linear sawing motion of the cable through the earth. A similar curved trench was filled with a high density fluid grout made from hydrated bentonite with sufficient hematite to make the grout about 20 percent denser than the soil. The cable was positioned in the bottom of the trench around a 12 foot radius 180 degree arc. When the dozers pulled, the cable sliced through the soil and the soil lifted, floating on the grout. Tensioning long lengths of cables on the surface is hazardous because cables stretch and release great energy when they break, so in the current invention, the tensioned section of cable is underground and attached to the pipes which are in turn pulled or pushed from the surface.

Field Test on Bentonite Grout—Floating a Soil Block

A field test was performed making a cut under a 50 ton block of earth with a pulled loop of ¾" diameter wire rope cable. A trench along the sides and connected to the path of the cut was filled with the dense bentonite grout before the cut was made. When the cable loop was pulled it sliced through the earth under the soil block and cut it free of the earth on all sides. The grout instantly followed the cable under the soil block. The soil block then floated in the dense fluid grout about 4 inches higher than the surrounding soil. An additional 18 inches of grout was added to completely fill the trench and the top of the soil block rose 18 inches higher. It was noted that the deeper side of the block floated higher than the shallower side of the block, thus confirming the buoyancy formula below. The grout and floating block was then covered and left to cure. After 6 months the grout in the barrier was the consistency of wet clay and was excavated and samples collected. The bentonite grout material reached a permeability of $1\times10^{-9}$ cm/sec after 6 months.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Whenever a numerical range with a lower limit and an upper limit is disclosed, any number falling within the range is specifically disclosed. Moreover, the indefinite articles "a" or "an", as used in the claims, are defined herein to mean one or more than one of the element that it introduces.

What is claimed is:

1. A method of forming a continuous underground panel comprising the steps of:

a) inserting at least two tethered pipes into a subterranean area that are connected by a tether cable that limits separation distance between the two pipes while spraying a fluid grout from at least one jet nozzle on at least one of the pipes with sufficient energy to cut the subterranean area to a radius that allows passage of the tether cable and produces a grouted panel between the tethered pipes; and b) retracting the tethered pipes from the subterranean area and relocating them along a desired path and re-inserting the tethered pipes while spraying fluid grout such that at least one of the tethered pipes is inserted in a new position and at least a remaining one of the tethered pipes tracks down a previously formed hole with the sprayed fluid grout and the tether cable passing through the grouted subterranean area to form another grouted panel between the tethered pipes that is adjoining with the previous grouted area so as to form one continuous underground panel, wherein the tether cable is a tensile member that rotationally orients the tethered pipes so that the jet nozzle points toward the adjacent tethered pipe and verifies continuity of the cut by its physical passage.

2. The method of claim 1 further comprising introducing compressed air into the fluid near the jet nozzle or from a concentric nozzle shrouded around the jet nozzle to increase the fluid grout's penetration distance into the soil.

3. The method of claim 1 wherein the fluid grout comprises a molten wax that is at a temperature that causes steam bubbles to form in the grout and soil mixture that increases the fluid grout's penetration.

4. The method of claim 1, further comprising pre-treating the subterranean area prior to spraying the fluid grout with a thermal transfer material comprising:

a) steam;
b) heated air; or
c) heated water.

5. The method of claim 1 wherein the tethered pipes are inserted in pre drilled holes and the tethered pipes move in or out of the holes as the continuous underground panel is being formed.

6. The method of claim 1 wherein movement of the tether cable acts as a knife to further cut the subterranean area and fluid grout is provided into the cut as the tether cable passes.

7. The method of claim 6 wherein insertion of the tethered pipes into the subterranean area is facilitated by percussive or resonant vibration drives that also vibrate the tether cable and cause it to cut through the subterranean area.

8. The method of claim 6 wherein spacing of the two pipes is controlled by angling the tethered pipes such that they tend to move away from each other as the pipes are driven or vibrated into the ground, while the cable limits their maximum separation distance.

9. The method of claim 1 wherein the tethered pipes are moved independently to create at least a partial sawing action by the tether cable.

10. The method of claim 1 wherein the fluid grout comprises:

a) molten wax modified with surfactant additives to increase soil wetting and permeation;
b) molten wax at least partially filled with sand, hematite, or barite weighting agents;
c) molten polyethylene with surfactant additives to increase soil wetting and permeation; or
d) molten tar.

11. The method of claim 1 wherein any lateral earth pressure of the soil that tends to squeeze shut the cut is overcome by maintaining pressure on the grout to increase its hydrostatic pressure within the cut.

12. The method of claim 1 wherein the tether cable is attached to the tethered pipes by a bearing means that allows for rotation of at least one of the tethered pipes spraying the fluid grout such that the panel formed comprises a column connected to previous columns.

13. The method of claim 1 wherein the tether comprises a rigid plate that limits movement of the tethered pipes towards each other, the rigid plate having parallel tubular means at either side that fit loosely around a reduced diameter portion of the tethered pipes while allowing at least one of the tethered pipes spraying fluid grout to rotate freely and form a panel comprising a column connected to previous columns.

14. The method of claim 1 wherein the fluid grout comprises molten wax wherein said molten wax comprises a weighting agent selected from the group consisting of sand, hematite and barite.

15. The method of claim 1 wherein the fluid grout comprises molten polyethylene with surfactant additives to increase soil wetting and permeation.

16. The method of claim 1 wherein the fluid grout comprises:

a) molten tar;
b) cement slurry;
c) bentonite slurry;
d) bentonite slurry with zero valence iron particles;
e) bentonite slurry with sand, hematite, or barite weighting agent;
f) combinations of cement and bentonite with hematite or barite weighting agents;
g) prehydrated bentonite slurry with additions of sand, hematite or barite weighting agents;
h) polyacrimide grout; or
i) sodium silicate grout.

17. The method of claim 1 wherein any lateral earth pressure of the soil that tends to squeeze shut the cut is overcome by adjusting a density of the grout to increase its hydrostatic pressure within the cut.

18. The method of claim 1 wherein any lateral earth pressure of the soil that tends to squeeze shut the cut is overcome by using a molten wax grout that permeates into walls of the cut.

19. The method of claim 1 wherein any lateral earth pressure of the soil that tends to squeeze shut the cut is overcome by using a chemical grout that permeates into walls of the cut.

* * * * *